US012262801B2

(12) United States Patent
Ma

(10) Patent No.: US 12,262,801 B2
(45) Date of Patent: Apr. 1, 2025

(54) UMBRELLA ASSEMBLY WITH COUNTERWEIGHT SYSTEM

(71) Applicant: Zhun-An Ma, Ningbo (CN)

(72) Inventor: Zhun-An Ma, Ningbo (CN)

( * ) Notice: Subject to any disclaimer, the term of this patent is extended or adjusted under 35 U.S.C. 154(b) by 178 days.

(21) Appl. No.: 17/856,634

(22) Filed: Jul. 1, 2022

(65) Prior Publication Data

US 2023/0018195 A1 Jan. 19, 2023

Related U.S. Application Data

(60) Provisional application No. 63/203,210, filed on Jul. 13, 2021.

(51) Int. Cl.
*A45B 25/02* (2006.01)
*A45B 25/14* (2006.01)

(52) U.S. Cl.
CPC ..... *A45B 25/02* (2013.01); *A45B 25/14* (2013.01); *A45B 2200/10* (2013.01)

(58) Field of Classification Search
CPC ..... A45B 25/02; A45B 25/14; A45B 2200/10
See application file for complete search history.

(56) References Cited

U.S. PATENT DOCUMENTS

| | | | |
|---|---|---|---|
| 593,726 | A | 11/1897 | Nicholls |
| 680,661 | A | 8/1901 | Hunt |
| 835,306 | A | 11/1906 | Mangelsdorf |
| 878,270 | A | 2/1908 | Blake et al. |
| 956,657 | A | 5/1910 | Wetteroth |
| 957,528 | A | 5/1910 | Wetteroth |
| D45,227 | S | 2/1914 | Glauber |
| 1,136,887 | A | 4/1915 | Penn |
| 1,235,296 | A | 7/1917 | Dillingham |
| 1,243,594 | A | 10/1917 | Dillingham |
| 1,255,627 | A | 2/1918 | Morrow et al. |
| 1,268,354 | A | 6/1918 | Howard |
| 1,801,913 | A | 4/1931 | Frederick |
| 1,881,990 | A | 10/1932 | Zitzer |

(Continued)

FOREIGN PATENT DOCUMENTS

| | | |
|---|---|---|
| AT | 128258 | 5/1932 |
| BG | 6965-0001 | 4/2009 |

(Continued)

OTHER PUBLICATIONS

Operation Manual Easy Sun Parasol Sunshade (Issue: Jul. 2004) pp. 1-17.

(Continued)

*Primary Examiner* — Noah Chandler Hawk
(74) *Attorney, Agent, or Firm* — Krobbe, Martens, Olson & Bear, L.L.P

(57) ABSTRACT

An umbrella is provided that includes a hollow pole, a shade assembly, a counterweight system, and a locking device. The shade assembly includes a guide rod coupled with an upper hub. The guide rod has a stop surface. The counterweight system has a ballast and a cord that has a first end coupled with the ballast and a second end coupled with a lower hub. The locking device has pushrod mechanism. When closing the umbrella, the pushrod mechanism moves upward disengaging a moveable locking surface from the guide rod to allow the lower hub to move downward and the ballast to move upward.

28 Claims, 18 Drawing Sheets

(56) References Cited

U.S. PATENT DOCUMENTS

D90,772 S 9/1933 Kasch
1,972,653 A 9/1934 Hart
2,013,192 A 9/1935 Sidney
2,223,253 A 11/1940 Hamilton
D127,735 S 6/1941 Dreyfuss
2,341,399 A * 2/1944 Timblin ..... A45B 25/04 156/581
2,447,972 A 8/1948 Weinert
2,462,560 A 2/1949 Schmidt
2,475,406 A 7/1949 Russell
D162,678 S 3/1951 Muller-Munk
D167,619 S 9/1952 Coran
2,661,012 A 12/1953 Militano
2,719,688 A 10/1955 Seifert
2,721,569 A 10/1955 Militano
2,745,421 A 5/1956 Russell
2,762,383 A 9/1956 Wittman
2,819,725 A 1/1958 Deisenroth et al.
RE24,477 E 5/1958 Small
D183,609 S 9/1958 Higgins
2,932,047 A 4/1960 Johnston
2,937,653 A 5/1960 Danciart et al.
D190,597 S 6/1961 Nelson
3,120,238 A 2/1964 Glatz
3,129,715 A 4/1964 Militano
3,142,307 A 7/1964 Danciart et al.
3,145,720 A 8/1964 Torii
3,171,418 A 3/1965 Meyer
3,175,568 A 3/1965 Kafka
3,177,882 A 4/1965 Militano
3,177,883 A 4/1965 Militano
3,253,310 A 5/1966 McCarthy
3,279,835 A 10/1966 Krohm
3,311,119 A 3/1967 Pearlstine
3,347,575 A 10/1967 Morris
3,395,717 A 8/1968 Weber
3,424,180 A 1/1969 Giancarlo
3,457,931 A 7/1969 Yoshio
3,521,651 A 7/1970 Pearlstine
D221,039 S 6/1971 Zimmerman
3,683,948 A 8/1972 Cohen
3,802,452 A 4/1974 Weber
3,856,032 A 12/1974 Schafer
D234,729 S 4/1975 Weber et al.
4,252,137 A 2/1981 Cohen
D265,498 S 7/1982 Paul
4,368,749 A 1/1983 Lindler et al.
4,385,849 A 5/1983 Crain
D276,838 S 12/1984 Hill et al.
4,586,525 A 5/1986 Glatz et al.
4,622,987 A 11/1986 Redl et al.
4,674,523 A 6/1987 Glatz
4,807,655 A 2/1989 Robertson
4,811,670 A 3/1989 Kolvites et al.
4,829,857 A 5/1989 Jones
4,878,509 A 11/1989 Tung
4,911,573 A 3/1990 Pietro
4,928,718 A 5/1990 Apple
4,993,445 A 2/1991 Dubinsky
5,002,081 A 3/1991 Stromeyer
5,020,557 A 6/1991 Apple
5,029,596 A 7/1991 Tung
5,050,627 A 9/1991 Hengtzu
5,174,319 A 12/1992 Chou et al.
5,186,197 A 2/1993 Lavine
5,284,171 A 2/1994 Liu
D344,786 S 3/1994 Short et al.
5,333,824 A 8/1994 Dubinsky
5,349,975 A 9/1994 Valdner
5,355,903 A 10/1994 Haddad et al.
5,357,994 A 10/1994 Chung
D366,826 S 2/1996 Heithaus
5,499,644 A 3/1996 Geniele
D372,854 S 8/1996 Jimenez
5,584,564 A 12/1996 Phyle
5,588,455 A 12/1996 Kuo
5,611,364 A 3/1997 Woods et al.
5,615,698 A 4/1997 Ko
5,617,888 A 4/1997 Wu
5,640,984 A 6/1997 Dubunsky
5,651,732 A 7/1997 Dufour
5,655,557 A 8/1997 Martin
5,740,823 A 4/1998 Lin et al.
5,740,824 A 4/1998 Tang
5,749,386 A 5/1998 Samuel, Jr.
5,779,386 A 7/1998 Eichhorn
5,785,069 A 7/1998 Glatz
D397,054 S 8/1998 Brantley et al.
D398,443 S 9/1998 Bolle
5,809,734 A 9/1998 Turner
5,816,276 A 10/1998 Seidel et al.
D400,777 S 11/1998 Carsello
5,836,328 A 11/1998 Lee
5,871,024 A 2/1999 Vanderminden, Sr.
5,884,645 A 3/1999 Chen et al.
D408,621 S 4/1999 Kuo
5,899,210 A 5/1999 Letherby et al.
D410,862 S 6/1999 Milhov
5,921,115 A 7/1999 Winner
5,937,882 A 8/1999 Harbaugh
6,014,980 A 1/2000 Glatz
D424,799 S 5/2000 Lai
6,082,383 A 7/2000 Wilson
6,129,101 A 10/2000 Dubinsky
D434,215 S 11/2000 Lin
D434,476 S 11/2000 Meda
6,145,523 A 11/2000 Lo
6,152,156 A 11/2000 Tung
D434,556 S 12/2000 Lin
6,170,497 B1 1/2001 Ma
6,192,907 B1 2/2001 Wu
6,216,712 B1 4/2001 Lin et al.
6,220,261 B1 4/2001 Glatz
6,230,728 B1 5/2001 Reese
6,247,483 B1 6/2001 Rung
6,305,394 B1 10/2001 Reese
6,311,705 B1 11/2001 Ma
6,311,707 B1 11/2001 Wu et al.
6,314,976 B1 11/2001 Clarke
6,345,639 B2 2/2002 Rousselle et al.
6,371,141 B1 4/2002 Lin et al.
6,371,686 B1 4/2002 Wu
6,374,840 B1 4/2002 Ma
6,386,214 B1 5/2002 Clarke
6,386,215 B1 5/2002 Chang
D458,904 S 6/2002 Montena
6,412,506 B1 7/2002 Reese
6,422,251 B1 7/2002 Tseng
6,446,650 B1 9/2002 Ma
6,478,037 B2 11/2002 Tung
6,516,820 B1 2/2003 Earnshaw
6,571,813 B2 6/2003 Lin et al.
6,575,182 B2 6/2003 Tung
6,575,183 B2 6/2003 Tung
D477,458 S 7/2003 Goldwitz
6,588,438 B1 7/2003 Steiner
6,595,713 B1 7/2003 Wilson
D478,416 S 8/2003 Clarke
6,619,306 B2 9/2003 Ma
6,662,815 B2 12/2003 Tung
D484,680 S 1/2004 You
D489,169 S 5/2004 You
D489,170 S 5/2004 You
D489,967 S 5/2004 Funk
6,732,753 B2 5/2004 Chang
6,758,229 B2 7/2004 Wang
D497,478 S 10/2004 Clarke
D497,479 S 10/2004 Yu
6,810,895 B2 11/2004 Lin et al.
6,837,255 B2 1/2005 Bunch et al.
6,848,459 B2 2/2005 Ma
6,851,823 B2 2/2005 Bilotti
D503,035 S 3/2005 Ko
6,889,699 B2 5/2005 Clarke

(56) References Cited

U.S. PATENT DOCUMENTS 6,920,887 B2 7/2005 Lo
6,941,960 B2 9/2005 Huang
D515,803 S 2/2006 You
7,000,624 B2 2/2006 Chang
D525,721 S 7/2006 Landes
7,082,953 B2 8/2006 Liu
7,089,950 B2 8/2006 Lin
D532,947 S 11/2006 Muscarella
7,182,713 B2 2/2007 Wang
D539,632 S 4/2007 Ma
7,204,261 B1 4/2007 Wu
7,255,118 B2 8/2007 Ma
7,281,542 B2 10/2007 Ko
D555,349 S 11/2007 You
7,293,573 B2 11/2007 Clarke
D558,444 S 1/2008 Ma
7,318,444 B2 1/2008 Clakre
7,328,715 B2 2/2008 Neubardt
7,412,985 B2 8/2008 Ma
D586,549 S 2/2009 Hermanson et al.
D586,550 S 2/2009 Hermanson et al.
D587,448 S 3/2009 You
7,546,845 B2 6/2009 Prusmack
D600,439 S 9/2009 Zonsius
7,600,734 B2 10/2009 Clarke
7,665,477 B1 2/2010 Hathaway
7,686,024 B1 3/2010 Lai
7,703,464 B2 4/2010 Ma
7,775,226 B2 8/2010 MacDonald et al.
7,806,130 B2 10/2010 Gobel
D631,243 S 1/2011 Forthuber et al.
7,861,734 B2 1/2011 Ma
7,891,367 B2 2/2011 Ma
7,900,643 B2 3/2011 Ma
7,913,708 B2 3/2011 Yung
7,913,709 B2 3/2011 Brebner
D637,388 S 5/2011 You
D640,464 S 6/2011 Forthuber et al.
7,980,262 B1 7/2011 You
8,020,572 B2 9/2011 Ma
8,053,042 B1 11/2011 Loomis
8,061,375 B2 11/2011 Ma
D650,984 S 12/2011 Pineda
8,082,935 B2 12/2011 Ma
8,087,420 B1 * 1/2012 Lukacsy ..... A45B 25/16 135/22
8,096,310 B2 1/2012 Clarke
8,100,139 B2 1/2012 Chong
D664,760 S 8/2012 Elder
8,272,391 B2 9/2012 Luo
8,298,633 B1 10/2012 Chen
8,443,819 B2 5/2013 Beaulieu
8,522,804 B1 9/2013 Tung
D704,044 S 5/2014 Makino
8,757,183 B2 * 6/2014 Volin ..... A45B 25/143 135/25.4
D714,132 S 9/2014 Hazantonis
8,899,250 B1 12/2014 Tung
D727,469 S 4/2015 Jorgensen
9,004,087 B2 4/2015 Ma
D731,166 S 6/2015 Ma
9,060,576 B2 6/2015 Siegenthaler
9,113,683 B2 8/2015 Ma
D753,271 S 4/2016 LaBarbera et al.
D759,955 S 6/2016 Ma
D759,956 S 6/2016 McQuaid
9,504,298 B2 11/2016 Li
9,844,288 B2 12/2017 Fu
D818,697 S 5/2018 Ma
10,016,033 B2 7/2018 Volin
10,562,172 B1 2/2020 Armstrong
10,736,390 B2 8/2020 Ma
10,758,015 B2 9/2020 Ma
10,945,381 B1 3/2021 Pringnitz
11,123,857 B1 9/2021 Ramsey
11,206,903 B2 12/2021 Ma
11,388,963 B2 7/2022 Ma
11,771,186 B2 10/2023 Ma
D1,003,592 S 11/2023 Ma
2001/0017150 A1 8/2001 Doreste
2002/0083969 A1 7/2002 Tung
2002/0139405 A1 10/2002 Lee
2003/0010367 A1 1/2003 Ko
2003/0015230 A1 1/2003 Glatz
2003/0062073 A1 4/2003 Tung
2004/0031513 A1 2/2004 Bunch et al.
2004/0055627 A1 3/2004 P. Moga
2004/0055628 A1 3/2004 Yu
2004/0069333 A1 4/2004 Ma
2004/0154525 A1 8/2004 Wirth et al.
2004/0182429 A1 9/2004 Chen
2004/0187900 A1 9/2004 Earnshaw
2004/0206382 A1 10/2004 Clarke
2004/0206383 A1 10/2004 Clarke
2005/0045217 A1 3/2005 Clarke
2005/0081902 A1 4/2005 Liu
2005/0098200 A1 5/2005 Su
2005/0238422 A1 10/2005 Hung
2005/0279520 A1 12/2005 Newman et al.
2006/0005867 A1 1/2006 Chang
2006/0005868 A1 1/2006 Fenton
2006/0046899 A1 3/2006 Wang
2006/0070644 A1 * 4/2006 Schneller ..... A45B 11/00 135/31
2006/0151018 A1 7/2006 Wilson
2006/0151019 A1 7/2006 Lo
2007/0113878 A1 5/2007 Ko
2007/0261728 A1 11/2007 Lin
2008/0041433 A1 2/2008 Caldwell
2008/0053498 A1 3/2008 Liu et al.
2008/0202570 A1 8/2008 Clarke
2009/0126769 A1 5/2009 Hoogendoorn
2009/0242065 A1 10/2009 Whitling et al.
2010/0139724 A1 6/2010 Lai
2010/0139725 A1 6/2010 Lai
2011/0061694 A1 3/2011 Vanderminden, Sr.
2011/0132418 A1 6/2011 Ma
2011/0209732 A1 9/2011 Ma
2011/0214705 A1 9/2011 Ma
2011/0241389 A1 10/2011 Tsai
2011/0277800 A1 11/2011 Tung
2012/0126533 A1 5/2012 Canale
2012/0155958 A1 6/2012 Donohue
2014/0109942 A1 4/2014 Ma
2014/0305476 A1 10/2014 Ma
2014/0376990 A1 12/2014 Lai
2015/0237976 A1 8/2015 Chow
2018/0298632 A1 10/2018 Ma
2019/0082802 A1 3/2019 Ma
2019/0203497 A1 7/2019 Mummert et al.
2019/0323531 A1 10/2019 Wang
2020/0297085 A1 9/2020 Ma
2020/0384328 A1 12/2020 Chua
2021/0112932 A1 4/2021 Ma
2022/0125169 A1 4/2022 Ma
2022/0265013 A1 8/2022 Ma
2022/0400822 A1 12/2022 Ma
2023/0270216 A1 8/2023 Ma

FOREIGN PATENT DOCUMENTS

CN 2579212 10/2003
CN 202060155 12/2011
CN 202190859 4/2012
CN 202588579 12/2012
CN 202636818 1/2013
CN 203168230 9/2013
CN 204181115 3/2015
CN 106889721 4/2017
CN 208280719 12/2018
CN 210581325 5/2020
CN 211229881 8/2020
DE 22 04 217 8/1973
DE 24 34 495 2/1975

(56) References Cited

FOREIGN PATENT DOCUMENTS

| | | | |
|---|---|---|---|
| DE | 3820573 | | 8/1989 |
| DE | 29516009 | | 11/1995 |
| DE | 202010011240 | | 11/2010 |
| DE | 202012007364 | | 11/2012 |
| DE | 202017002887 | | 7/2017 |
| DE | 202019103816 | | 7/2019 |
| EM | 007772157-0001 | | 3/2020 |
| EP | 0 628 264 | | 12/1994 |
| EP | 1 302 120 | | 3/2005 |
| EP | 1 510 145 | | 3/2005 |
| EP | 2 289 364 | | 3/2011 |
| EP | 4 118 998 | | 1/2023 |
| FR | 2612551 | | 9/1988 |
| FR | 2672781 | A3 | 8/1992 |
| JP | 58-107024 | | 7/1983 |
| JP | S61-37814 | | 3/1986 |
| JP | H08-322621 | | 12/1996 |
| JP | 2000-139533 | | 5/2000 |
| JP | 2001-046131 | | 2/2001 |
| JP | 2006-110317 | A | 4/2006 |
| JP | 2007-222591 | | 9/2007 |
| JP | 2008-142310 | | 6/2008 |
| JP | 3144314 | | 7/2008 |
| JP | 2009-045359 | | 3/2009 |
| JP | 2009-247750 | | 10/2009 |
| WO | WO 2005/058089 | | 6/2005 |
| WO | WO 2007/092514 | | 8/2007 |
| WO | WO 2013/013474 | | 1/2013 |
| WO | WO 2018/084181 | | 5/2018 |

OTHER PUBLICATIONS

Amazon.com, Site visited Feb. 7, 2023, ITT AHO Heavy Duty Telescoping Extension Pole, First available Dec. 21, 2019, https://us.amazon .com/ITTAHO-Aluminum-Telescopic-Extension-Telescoping/dp/B07ZT8M9VD (Year: 2019).

Shadeaustralia.com.au, Site visited Jan. 23, 2023, Shelta Como Umbrella, oldest review dated Dec. 7, 2017, https://www.shadeaustralia.com.au/como-timber-umbrella (Year: 2017).

Youtube.com, Site visited Jan. 24, 2023, "Cool Pool Products Umbrella Sleeve," published on Jul. 19, 2019 by CoolPoolProducts: https:// www .youtube.com/watch?v=x_qAK8QDJ Ko&list=TLGGy0td2PTduXUyNDAxMjAyMw (Year: 2019).

Youtube.com, Site visited Feb. 10, 2023, "Testrite Telescopic Tubing and Locks," published by Testrite on Sep. 26, 2017 features the FA Spring Button A-Clutch Lock: https://www.youtube.com/watch?v=Lp2uGtOGZRA (Year: 2017).

* cited by examiner

UMBRELLA ASSEMBLY WITH COUNTERWEIGHT SYSTEM

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 C.F.R. § 1.57.

BACKGROUND

Field of the Invention

This application is directed to umbrella assemblies having hub position locking systems and/or counterweight systems configured to assist the opening and/or closing of the umbrella and to ornamental designs of hubs and other components therefor.

Description of the Related Art

Many umbrellas are opened and closed by pushing a slider up and down a center pole of the umbrella. The length of the ribs of umbrellas usually depends on the size of the shade member. The larger the shade member, the longer the ribs are likely to be. Depending on the length of the ribs, the opening and closing of the umbrella can be interfered with by surrounding objects, such as tables and other furniture. This may impact the locations where the umbrellas can be used. Some umbrellas raise a top hub of the umbrella to try and avoid the surrounding objects. However, this may cause other issues such as instability due to wind.

SUMMARY

Instability due to wind points to a need for a locking device keeping a shade portion of the umbrella in an open or closed position. Such devices are important to provide a user with a stable umbrella that will not open or close independent of any action by the user. In view of the foregoing, improved umbrella assemblies incorporating counterweight systems are needed. Improved umbrella assemblies with locking devices for securing at least one of an open and a closed state are needed.

In various embodiments, an umbrella assembly is provided that includes a lower hub that can be moved up to open the umbrella and down to close the umbrella. The movement of the lower hub allows for movement of an upper hub that moves up when the umbrella is closed and down when the umbrella is opened. External factors, such as wind, can cause instability in the umbrella. Disclosed embodiments of this application encompass improved locking devices to better maintain the open position in a wide range of use conditions. Additionally, this invention increases the tolerance for the shade structure during production which is more conducive for mass production.

In one embodiment, an umbrella is provided that has a pole assembly, a shade assembly, a counterweight system, locking device, and a handle. The pole assembly has an upper portion and a lower portion. The pole assembly encloses an interior space disposed along a longitudinal axis thereof.

The shade assembly is disposed above the lower portion of the pole assembly and coupled to the upper portion of the pole assembly. The shade assembly has two or more ribs with a corresponding number of struts, a shade member, an upper hub, and a lower hub that is moveable along the pole assembly. The struts are coupled at one end to the ribs and are coupled at the other end to the lower hub. The upper hub includes a guide rod that is disposed within the pole assembly. The guide rod has one or more, e.g., at least two, recesses extending into the guide rod.

The counterweight system is disposed within the interior space of the pole assembly. The counterweight system has a ballast, a cord, and a pulley. The cord is coupled at a first end with the ballast and coupled at a second end with the lower hub. The cord is disposed over the pulley between the first and the second end of the cord.

The locking device has a hook assembly and a pushrod mechanism. The hook assembly can be disposed on or mounted on the pole assembly. The hook assembly has one or more (e.g., two or at least two) prongs that are sized to fit within the one or more (e.g., two or at least two) recesses of the guide rod. The hook assembly can have a spring configured to urge the prongs into the one or more recesses to lock the umbrella in an open position. The pushrod mechanism has a fixture coupled with a lower end of the guide rod and a lower surface disposed opposite to the fixture.

The handle extends downward from a lower portion of the lower hub. When opening the umbrella, the handle can be raised to raise the lower hub in the upward direction along the pole assembly as the ballast moves down within the interior space of the pole assembly. At the same time the upper hub is lowered until the one or more, e.g., at least two, recesses are aligned with the prong(s).

When closing the umbrella, the lower surface is actuated to move the fixture upward to disengage the prong(s) from the recess(es) of the guide rod. This allows the handle to move downward and the ballast to move upward.

In another embodiment, the fixture of the umbrella can further have an upper corner that is configured to disengage the prongs wherein the upper corner is angled.

In another embodiment, the fixture can have at least one width that corresponds to a width of an inner passage of the guide rod. The width of the fixture can be less than that of the fixture such that the fixture can slide within the inner passage. The width of the fixture can be sized relative to the passage to maintain the rotational position of the fixture within the passage.

In another embodiment, the pulley can be mounted to the upper portion of the pole.

In another embodiment, an umbrella is provided that has a pole assembly, a shade assembly, a counterweight system, and a locking device. The pole assembly encloses an interior space disposed along a longitudinal axis.

The shade assembly is coupled to an upper portion of the pole assembly. The shade assembly has a plurality of ribs, a plurality of struts, a shade member, an upper hub, and a lower hub. The struts are coupled at one end to a corresponding one of the ribs and at an opposite end to the lower hub. The upper hub has or is coupled with a guide rod disposed within the pole assembly. There is at least one recess extending into the guide rod.

The counterweight system is disposed within the interior space of the pole assembly. The counterweight system has a ballast and a cord. The cord has a first end coupled with the ballast and a second end coupled the lower hub. The locking device has a hook assembly and a pushrod mechanism. The hook assembly has at least one prong sized to fit within the at least one recess. A spring is optionally provided. Where provided, the spring can be configured to urge the at least one prong into engagement with the at least one recess to lock the umbrella in an open state. The pushrod mechanism has a pushrod and a fixture. The pushrod is coupled to the fixture. The fixture is coupled with a lower end of the guide rod.

When closing the umbrella, the pushrod is actuated to move the fixture upward to disengage the at least one prongs from the at least one recess of the guide rod. This allows the lower hub to be moved downward and the ballast to move upward.

In another embodiment, there may be a plurality of recesses extending into the guide rod. In another embodiment, the umbrella can further comprise a handle extending downward from a lower portion of the lower hub.

In another embodiment, the cord can be disposed over a pulley.

In another embodiment, when opening the umbrella, the lower hub can be raised in the upward direction along the pole assembly as the ballast moves down within the pole assembly, while at the same time the upper hub is lowered until the at least one recess is aligned with the at least one prong.

In another embodiment, the fixture can have an upper corner configured to disengage the at least one prong wherein the upper corner is angled.

In another embodiment, the fixture can have at least one width that corresponds to a width of an inner passage of the guide rod. The width of the fixture can be less than that of the fixture such that the fixture can slide within the inner passage. The width of the fixture can be sized relative to the passage to maintain the rotational position of the fixture within the passage.

In another embodiment, an umbrella is provided that has a hollow pole, a shade assembly, a counterweight system, and a locking device. The shade assembly is coupled with an upper portion of the hollow pole. The shade assembly has an upper hub, a lower hub, a shade structure, a shade member, and a guide rod. The shade structure couples the upper hub to the lower hub. The shade structure supports the shade member. The lower hub is moveable along the hollow pole. The guide rod is coupled with the upper hub at a first end. A second end of the guide rod is disposed within the hollow pole. The guide rod has a stop surface.

The counterweight system is disposed within the hollow pole. The counterweight system has a ballast and a cord. The cord has a first end coupled with the ballast and a second end coupled with the lower hub.

At least a portion of the locking device is disposed on and/or in the hollow pole. The locking device has a moveable locking surface and a pushrod mechanism. The moveable locking surface can be coupled with the hollow pole. The moveable locking surface is sized to overlap with the stop surface to lock the umbrella in an open state. When closing the umbrella, the pushrod mechanism moves upward disengaging the moveable locking surface from the stop surface of the guide rod. This allows the lower hub to be moved downward and the ballast to move upward.

In another embodiment, the locking device further comprises a fixture coupled to the pushrod at an upper end thereof. The fixture is configured to urge the locking surface away from the stop surface.

In another embodiment, the moveable locking surface comprises a hook.

In another embodiment, the stop surface comprises a recess configured to engage the hook.

In another embodiment, the umbrella further comprises a fixture coupled to the pushrod mechanism wherein when closing the umbrella, the fixture disengages the moveable locking surface from the stop surface.

In another embodiment, the umbrella further comprises a hook pivotably mounted in the lower hub. The hook is configured to rest on a ledge of the pole assembly when the umbrella is open and to pivot away from the ledge to allow the umbrella to be closed. The pivoting of the hook is actuated by downward movement of a handle portion of the lower hub.

In another embodiment, the hook comprises a curved lower portion that is actuated by movement of a roller disposed in the handle.

In another embodiment, the cord is disposed over a pulley coupled with the pole assembly and is tension by downward movement of the lower hub.

In another embodiment, the umbrella further comprises a spring configured to engage the moveable locking surface with the stop surface.

In another embodiment, the fixture has an upper corner configured to disengage the at least two prongs wherein the upper corner is angled.

In another embodiment, the upper corner comprises a wedge surface configured to act on a wedge surface of the hook.

In another embodiment, downward movement of the lower hub raises the ballast into engagement with an extender coupled with the guide rod and further downward movement of the lower hub causes the guide rod to apply an upward force to the extender and thereby to the guide rod to raise the upper hub.

In another embodiment, the umbrella further comprises an upper spacer coupled with a lower portion of the guide rod and a lower spacer disposed below the upper spacer. The upper and lower spacers are disposed in the pole assembly. The pushrod mechanism is moveable through the spacers between a position below the locking surface to a position at or above the locking surface.

In another embodiment, the pushrod mechanism includes a fixture coupled with an upper portion of a pushrod. The pushrod has a slot disposed therethrough. The slot can at least partially limit the range of motion of the fixture.

In another embodiment, the umbrella further comprises a guide rod lifting mechanism comprising a second cord coupled at a first end and at a second end opposite the first end with an upper portion of the hollow pole. The second cord having a span extending from the first end to a second end. The span of the second cord is disposed over a pulley. The span of the second cord being coupled with an upper end of an extender within the guide rod, wherein downward movement of the lower hub causes upward movement of the extender, whereby the length of a portion of the span of the second cord between the pulley and the first end of the cord is shortened and the guide rod and the upper hub are raised.

In another embodiment, the guide rod lifting mechanism comprises a second pulley. The span of the second cord extends between the first end and the first pully, over the upper end of the extender, and from the second pulley to the second end, wherein the length of a portion of the span of the second cord between the second pulley and the second end of the cord is shortened when the lower hub is moved downward.

In some embodiments, an umbrella hub as shown and described is provided.

BRIEF DESCRIPTION OF THE DRAWINGS

Features of the invention can be better understood from the following detailed description when read in conjunction with the accompanying schematic drawings, which are for illustrative purposes only. The drawings include the following figures.

DETAILED DESCRIPTION

While the present description sets forth specific details of various embodiments, it will be appreciated that the description is illustrative only and should not be construed in any way as limiting. Furthermore, various applications of such embodiments and modifications thereto, which may occur to those who are skilled in the art, are also encompassed by the general concepts described herein. Each and every feature described herein, and each and every combination of two or more of such features, is included within the scope of the present invention provided that the features included in such a combination are not mutually inconsistent.

This application is directed to new umbrella assemblies that facilitate one or both of counterweight assist in the opening and/or closing of large umbrellas and position locking of one or more hubs of an umbrella to enhance stability of the umbrella in an open or closed state. These assemblies can be embodied in or operate with novel hub configurations and designs. A combination of one or more, e.g., one or more pairs, e.g., two pairs of pulleys on or within a pole assembly facilitate movement of the upper and lower hubs as well as a ballast of a counterweight system.

Figure 1:
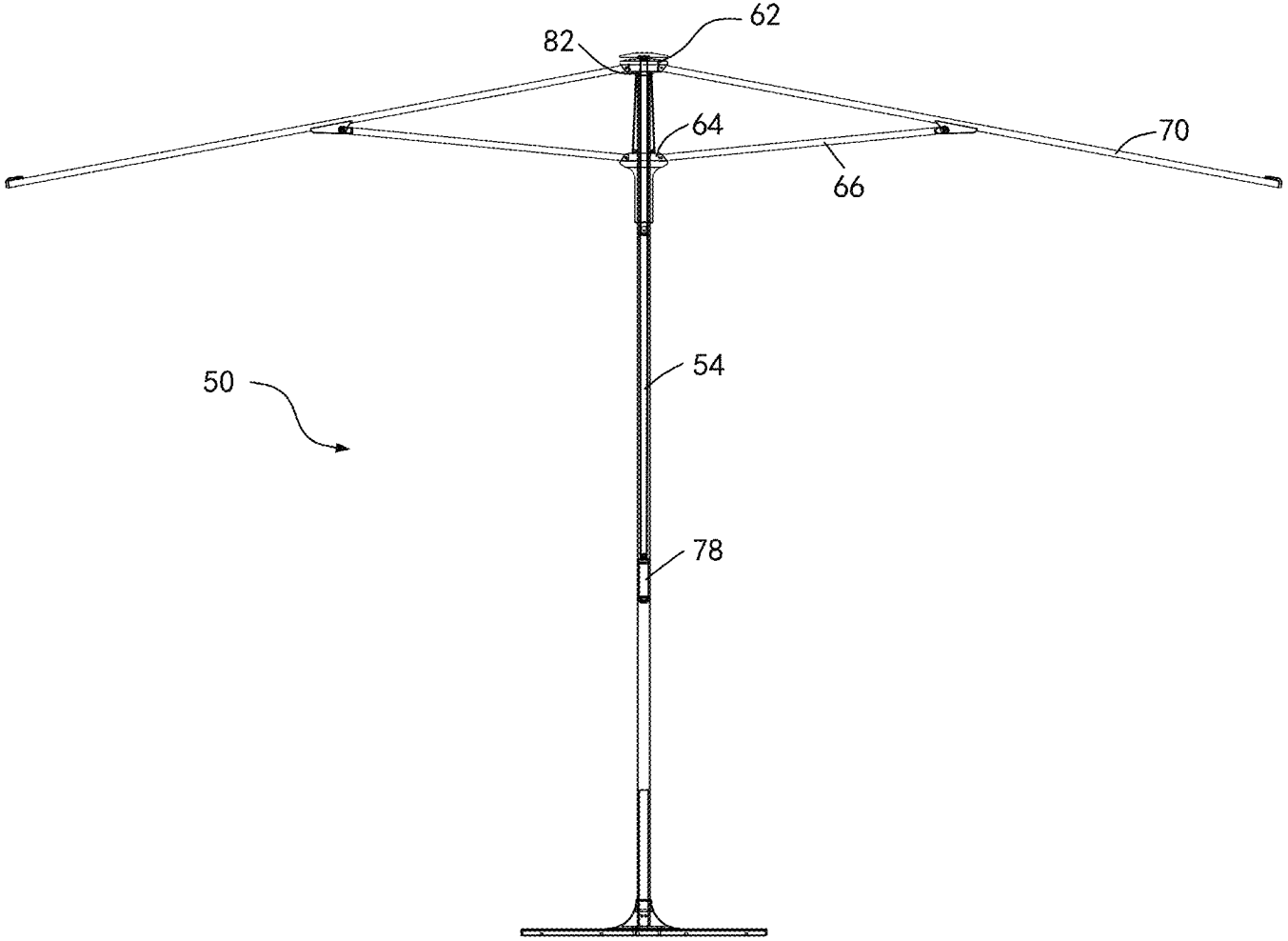
FIG. 1 shows an umbrella including a pole assembly, a shade assembly, an upper hub, a lower hub and a counterweight assembly.
Figure 2:
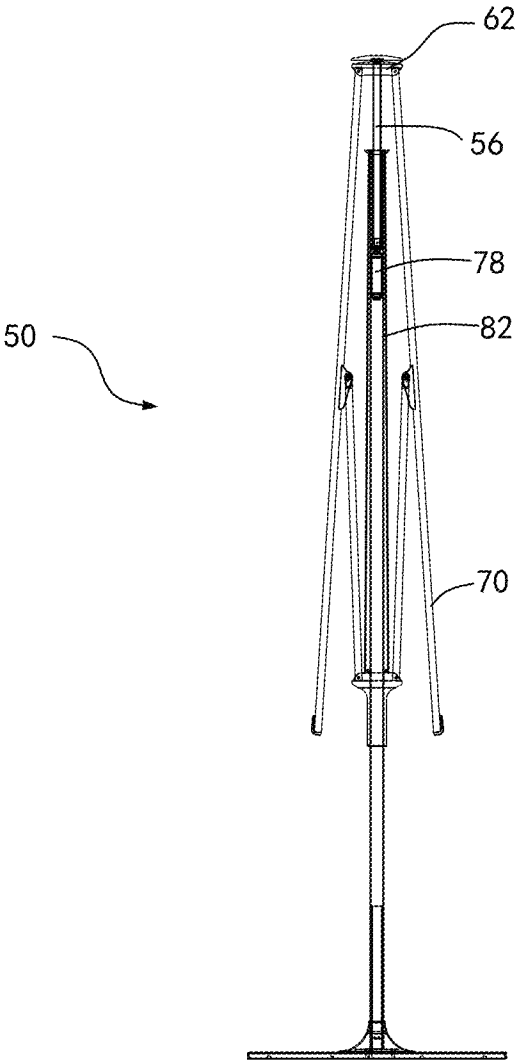
FIG. 2 shows the umbrella of FIG. 1 in a closed state where the upper hub has moved upwards compared to the position shown in FIG. 1.

FIGS. 1 and 2 show an umbrella assembly 50 including a pole assembly 54, a guide tube 56, a shade assembly 58, an upper hub 62, a lower hub 64, a ballast 78, and a pulley 82. The shade assembly 58 includes ribs 66, struts 70, and a shade member (not shown). The ribs 70 are coupled to the upper hub 62 along their length to one end of corresponding struts 66 at the other end. The end of the struts 66 that are not coupled to the ribs 70 are coupled to the lower hub 64. When the umbrella assembly 50 closes the lower hub 64 is lowered and the upper hub 62 is raised as shown in FIG. 2. The raising of the upper hub 62 also elevates the ribs 70. If the upper hub 62 were not enabled to be raised during closing of the umbrella the lower end of the ribs 70 would swing down much lower than is seen in FIG. 2. Thus, the elevation of the upper hub 62 while closing prevents the long ribs 70 from coming in contact with other objects, such as tables or chairs, when closing.

Figure 3:
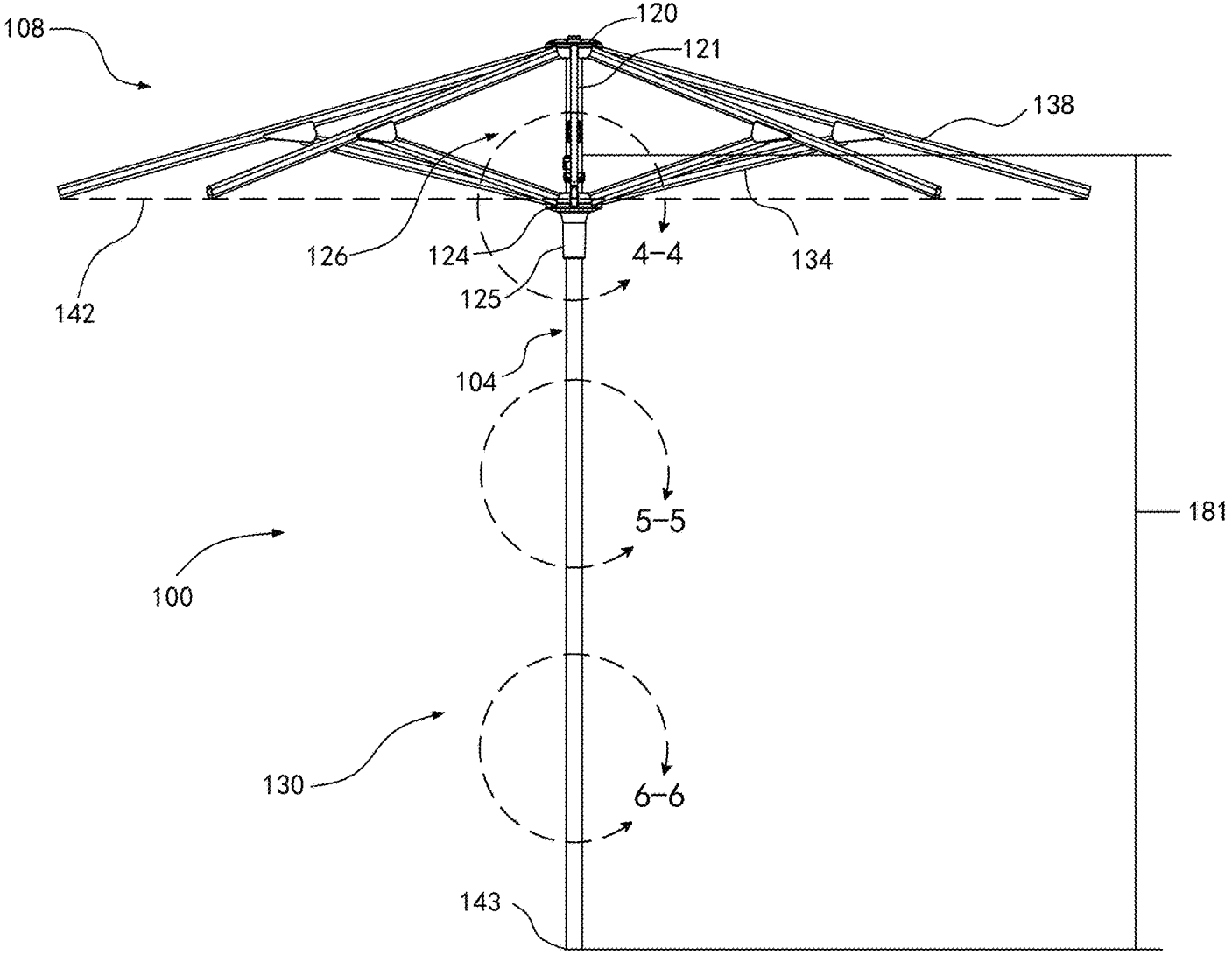
FIG. 3 shows one embodiment of an improvement of an umbrella similar to that of FIG. 1.
Figure 4:
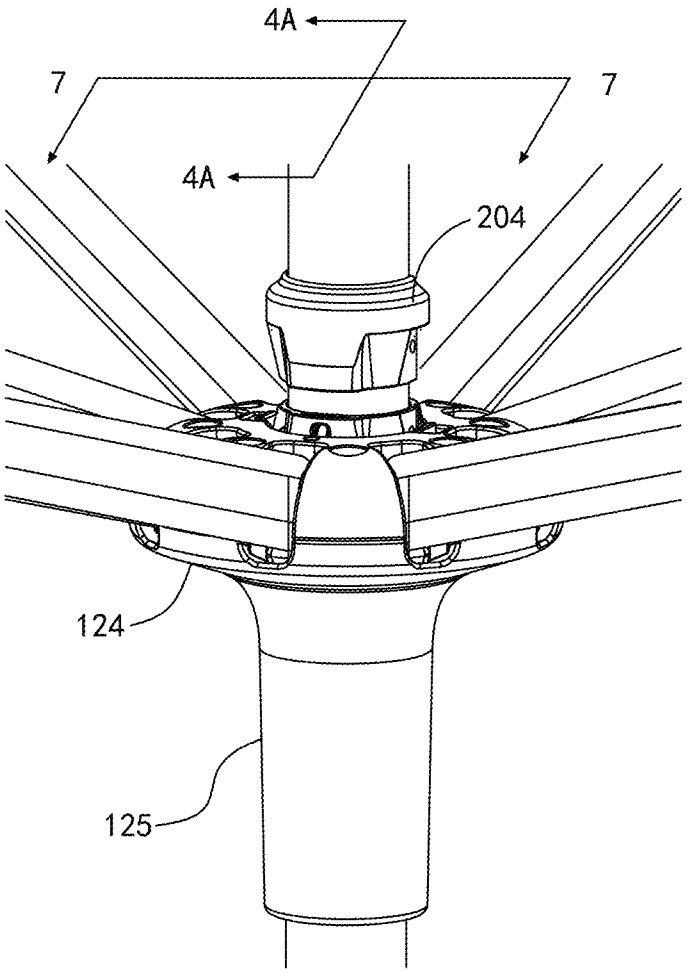
FIG. 4 shows a lower hub, a handle, and a covered locking device of the umbrella of FIG. 3.
Figure 4A:
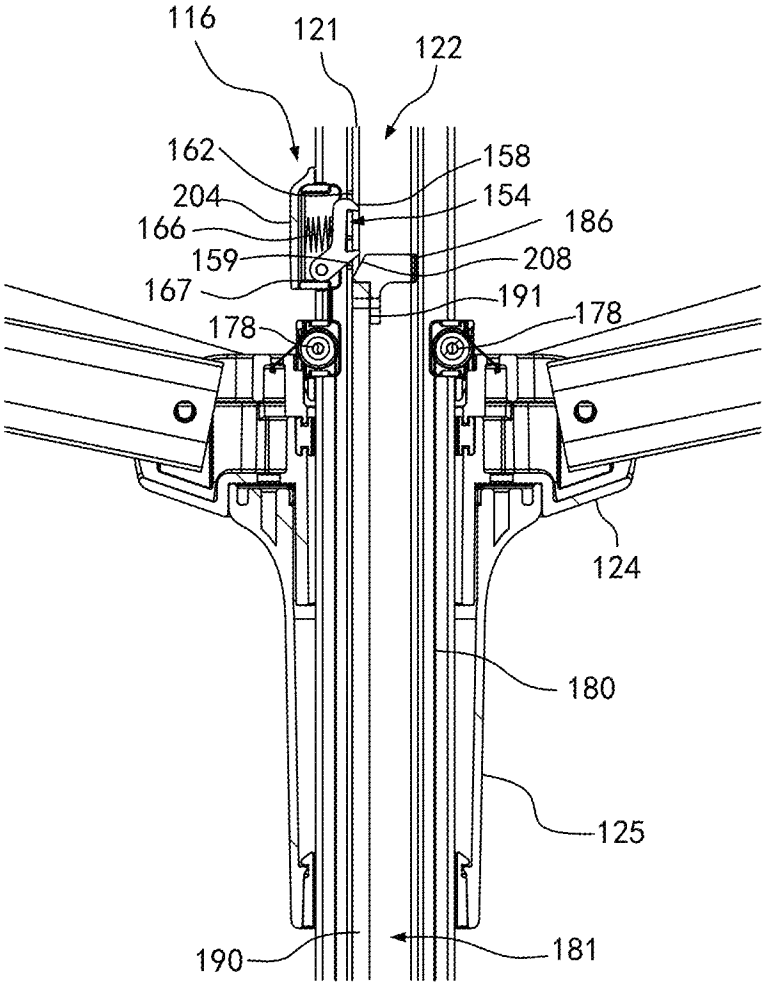
FIG. 4A shows a cross section of the umbrella FIG. 4 showing features of a counterweight assembly and a locking device including a hook, a pushrod mechanism, a pulley, and a cord.

FIG. 3 shows an example improved umbrella 100 including a pole assembly 104 and a shade assembly 108, the shade assembly 108 including an upper hub 120 and a lower hub 124. The umbrella 100 also includes a counterweight assembly 112 in some embodiments, for example as shown in FIG. 6A. The umbrella 100 also includes a locking device 116 in some embodiments, for example, as shown in FIG. 4A. The pole assembly 104 can include an upper portion 126 and a lower portion 130. The pole assembly 104 can enclose an interior space along a central longitudinal axis. The shade assembly 108 can be disposed above the lower portion 130 of the pole assembly 104. The shade assembly 108 includes struts 134 and ribs 138. There can be any number of struts 134 and ribs 138, for example three, four, five, six, or more ribs. The struts 134 can be coupled to ribs 138 at or near a first end and coupled to the lower hub 124 at a second end. The ribs 138 can be coupled to the upper hub 120 at or near a first end and can have a second end opposite the first end connected to a shade member 142 (shown in dashed lines) of the shade assembly 108. The upper hub 120 can move upwards when the umbrella 100 is closed (e.g., as shown in FIG. 2).

The lower hub 124 can be disposed on the pole assembly 104. The lower hub 124 can be moveable along the pole assembly 104. For example, the lower hub 124 can be moved in the downward direction to close the umbrella 100 and moved in the upward direction to open the umbrella 100. The lower hub 124 can include a handle 125 disposed on the pole assembly 104. In some embodiments, the handle 125 can be pulled down and pushed up to move the lower hub 124 along the pole assembly 104. The handle 125 can also function to disengage a locking mechanism of the lower hub 124 as discussed further below. In some embodiments a separate handle 125 may not be needed and a lower hub 124 can function as both a handle and lower hub. The upper hub 120 can be disposed at least partially at or near the upper portion 126 of the pole assembly 104. The upper hub 120 can include a guide rod 121 that is moveable within the pole assembly 104. The guide rod 121 can include an inside passage 122 defined within a hollow space of the guide rod.

FIGS. 4-6A show further details of the counterweight assembly 112 and the locking device 116. The locking device 116 works with the counterweight assembly 112 in some embodiments to enable the user to manipulate the umbrella 100 between open and closed states and also to provide for securing the umbrella 100 in one of these states, e.g., in the open state. In some embodiments, the locking device 116 can be used without a counterweight assembly 112.

Figure 5:
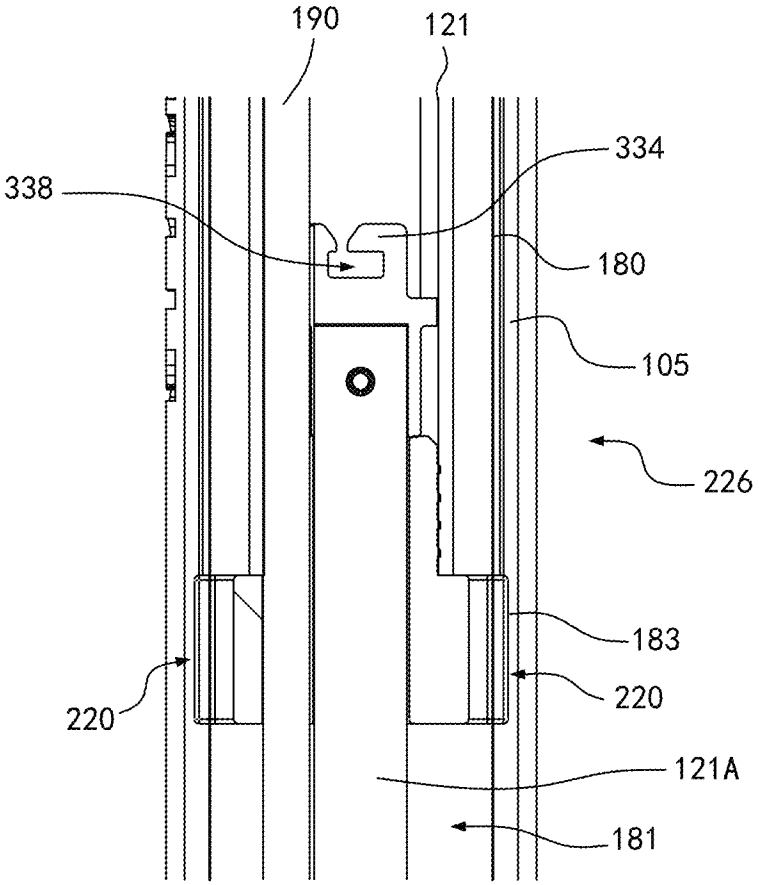
FIG. 5 shows a cross section of the umbrella FIG. 4 illustrating a central portion of a pole assembly including a pushrod.
Figure 6:
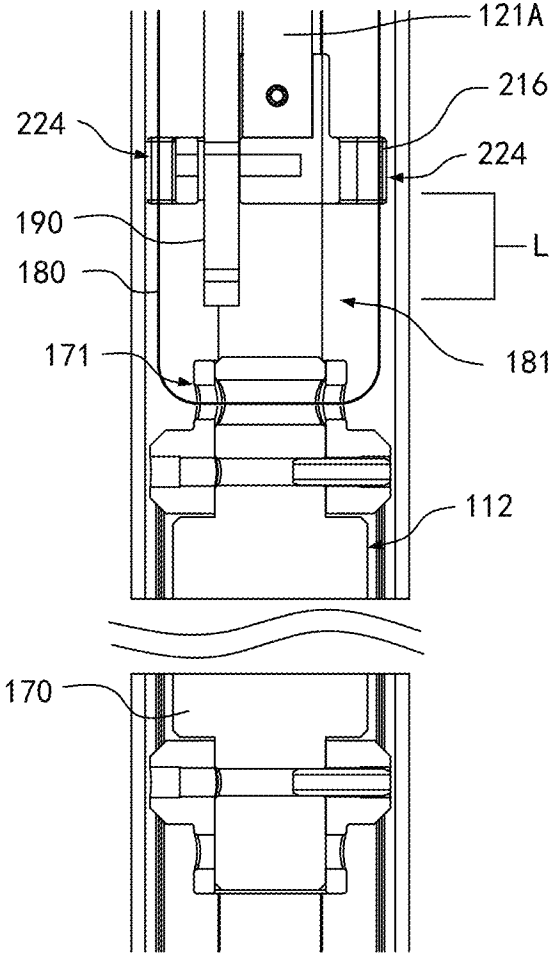
FIG. 6 shows a cross section of the umbrella FIG. 4 illustrating a pole assembly including a ballast connected to a cord and a bottom portion of a push rod.
Figure 6A:
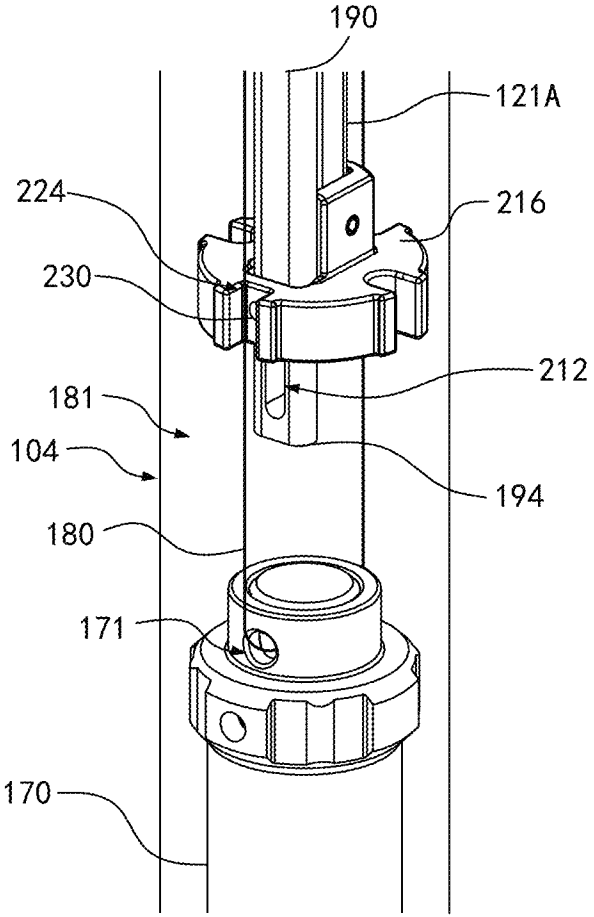
FIG. 6A shows a top perspective view of portion of a push rod and a ballast disposed within a lower portion of a pole assembly, an outer pole portion shown in phantom.

The counterweight assembly 112 can include a ballast 170 (e.g., as shown in FIG. 6), a pulley 178 (e.g., as shown in FIG. 4A), and a cord 180 (e.g., as shown in FIGS. 4A, 5 and 6). The counterweight assembly 112 can be disposed within the interior of the pole assembly 104. As shown in FIG. 4A, two pulleys 178 can be located along the pole assembly 104 above the lower hub 124. The cord 180 can be attached to the lower hub 124 by any suitable means. For example, one or more ends of the cord 180 can be anchored in a passage of an upper portion of the lower hub 124. The cord 180 can be positioned over a first pulley 178 and can extend down the interior of the pole assembly 104. In one embodiment, a space 181 is defined within the interior of the pole assembly 104 between, at, or near the lower hub 124 and the lower end 143 of the pole assembly 104. The space 181 can be hollow and the cord 180 can be positioned within the space 181. As shown in FIG. 5, the cord 180 extends between an outer surface of the guide rod 121 and the inner wall 105 of the pole assembly 104. In some embodiments, the guide rod 121 does not extend to the lower end 143 of the pole assembly 104. As shown in FIG. 5, the guide rod 121 can end or have a lowermost portion at an intermediate portion 226 of the pole assembly 104. The cord 180 can pass through two openings 220 when extending through space 181. The openings 220 can be disposed through an upper spacer 183 coupled with a lower end of the guide rod 121. The upper spacer 183 can help to maintain the guide rod 121 in alignment within the pole assembly 104.

As shown in FIGS. 6 and 6A, the cord 180 can continue to extend through space 181. The cord 180 can pass through two spacer openings 224 of a lower spacer 216. The cord 180 can be attached to the ballast 170 and the remaining portion of the cord 180 can extend up the interior of the pole assembly 104, as previously described, and can be positioned over a second pulley 178 and attached to the lower hub 124 by any suitable means. In one embodiment, the ballast 170 includes a channel 171 and the cord 180 is passed or threaded through the channel 171, as shown in FIG. 6. In this approach a single cord can extend from the first pulley 178 to the second pulley 178.

When the umbrella is opened, the handle 125 can be pushed upwards moving the lower hub 124 in the upward direction as the length of the cord 180 disposed between the pulley 178 and the lower hub 124 becomes less as more of the cord 180 is disposed between the pulley 178 and the ballast 170. The movement of the lower hub 124 upward will move the ballast 170 downward within the interior of the pole assembly 104. When the umbrella is closed, the handle 125 can be pulled downward which will move the lower hub 124 downward and the ballast 170 will move upward. This movement will cause more length of the cord 180 to be disposed between the pulley 178 and the lower hub 124. Stated another way, the ballast 170 can be configured as a weight that unless restrained will be guided by gravity downward within the space 181 of the pole assembly 104. The downward movement of the ballast 170 will raise or will help to raise the lower hub 124 which will cause the struts 134 and the ribs 138 (together a frame) of the shade assembly 108 to open.

Although the ballast 170 tends to hold the umbrella 100 in an open configuration absent a user collapsing it, the open position can be secured by one or more locking devices. As discussed above, the locking device 116 secures the elevation of the guide rod 121 relative to the outer pole of pole assembly 104. Also, as discussed further below, one or more hooks 234 disposed within the lower hub 124 can secure the elevation of the lower hub 124 relative to the pole assembly 104.

A pushrod 190 and a hook assembly 154 (discussed below) can form parts of the locking device 116. The hook assembly 154 can lock the position of the upper hub 120 relative to the pole assembly 104 in an open state. The pushrod 190 can be used to disengage the hook assembly 154 as discussed below. In one convenient configuration the pushrod 190 is operated by movement of the ballast 170 within the space 181 disposed within the pole assembly 104. The distance the pushrod 190 can be moved by the ballast 170 in order to push the pushrod 190 up to the hook assembly 154 can be predetermined. As discussed further below, a wedge element can be used to urge prongs 158 of the hook assembly 154 out of recesses 162 formed in or through the guide rod 121. For example, in some embodiments the ballast 170 can move the pushrod 190 upward a distance L (see FIG. 6). The distance L can be sufficient for the pushrod 190 to disengage the locking device 116, as described herein. As shown in FIG. 6A, a slot 212 positioned in the pushrod 190 can be configured to limit the distance L that the pushrod 190 can move relative to a lower spacer 216. As described above, the ballast 170 will move the pushrod 190 in the upward direction. When the pushrod 190 has moved a distance L, the slot 212 and a rod or pin 230 extending from the lower spacer 216 through the lower spacer 216 will prevent further movement of the pushrod 190. The pin 230 can extend through the slot 212 and into the lower spacer 216 to limit the movement of the pushrod 190. The bottom 194 of the pushrod 190 will now be at or near the bottom of the lower spacer 216.

Limiting movement can be beneficial because it limits the amount of movement necessary to disengage the locking device 116 to allow the umbrella 100 to close when in an open configuration, therefore reducing potential problems due to internal movement of parts. In some embodiments, the ballast 170 continues to move in the upward direction once the pushrod 190 has moved a distance L. The ballast 170 will continue to move in the upward direction which will move the guide rod 121 in the upward direction. In some embodiments, the upward movement of the guide rod 121 can cause the upper hub 120 to move upwards when the umbrella is closing as described herein. In one embodiment, the guide rod 121 is above the ballast and an extender 121A may be provided between a lower end of the guide rod 121 and the ballast 170. The extender 121A can be a member configured to support a compressive load such that as an upward force is applied by the ballast 170 to the lower spacer 216, that load is transferred to the extender 121A and is transferred by the extender 121A to the guide rod 121.

The hook assembly 154 can be coupled with the intermediate portion 167 of the pole assembly 154. The hook assembly 154 can be covered by a cover 204 to protect the hook assembly 154 from external elements. The hook assembly 154 can include prongs 158. Any number of prongs 158 can be used. For example, one, two, three, or more, prongs 158 can be used. The lowest of the prongs 158 can have an angled lower portion 159 that will engage with the fixture 186 described herein. The prongs 158 are configured to fit into corresponding recesses 162 in or through the guide rod 121. The corresponding recesses 162 can have sufficient space to allow the prongs 158 to engage and disengage from the recesses 162. In the illustrated embodiment, the recesses 162 extend through guide rod 121 but the recesses do not have to extend all the way through the guide rod 121. The guide rod 121 can be positioned in and moveable within the pole assembly 104. The prongs 158 can be urged into the corresponding recesses 162 by a spring 166 to lock the umbrella in an open state. Any suitable spring 166, e.g., a coil spring, a torsion spring, a leaf spring, can be used.

The pushrod 190 can be part of a pushrod mechanism 174 (e.g., as shown in FIG. 4A). The pushrod mechanism 174 can include a fixture 186 that can be coupled to the guide rod 121 and coupled to side surface 191 of the pushrod 190. The fixture 186 is configured to disengage the prongs 158 from the corresponding recesses 162 when the umbrella is closed. The fixture 186 can be any suitable shape. In one embodiment, the fixture can be at least partially wedge-shaped. An angled upper corner 208 of the fixture 186 can form a portion of a wedge that is configured to have disengage the prongs 158 from the recesses 162. The angled upper corner 208 can be positioned over the pushrod 190 as shown in FIG.4A. The fixture 186 has an outer periphery 187 that has a square or rectangular shape. The shape of the outer periphery 187 can be the same as the inner walls of the guide rod 121. The width of the fixture 186 corresponds to the width of the inside passage 122 of the guide rod 121. The corresponding widths and the outer periphery 187 matching up with the inner walls of the guide rod 121 allows the fixture 186 to engage with the prongs 158 of the hook assembly 154. The corresponding widths will prevent or limit the fixture 186 from deflecting away from the prongs 158 when the fixture 186 pushes against the angled lower portion 159 of the prongs 158.

When the umbrella is opened the ballast 170 moves downward. The ballast 170 moving downward allows for the pushrod 190 to move downward and the fixture 186 to move downward. The fixture 186 moving downward can allow the spring 166 of the hook assembly 154 to urge the prongs 158 into the corresponding recesses 162 to lock the umbrella in an open state. The use of two prongs 158 can be beneficial to increase the stability of the umbrella 100 in a locked or open state.

As described herein, when the umbrella 100 is to be closed the ballast 170 is moved upward. The ballast 170 moving upward pushes the pushrod 190 upward which advances the fixture 186 upward toward the prongs 158. When the angled upper corner 208 of the fixture 186 contacts the angled lower portion 159 of the prongs 158, the fixture 186 disengages the prongs 158 from the corresponding recesses 162. Where the fixture 186 and the lower prong 158 have an angled shape, the prongs 158 more easily disengaging from the corresponding recesses 162. The angled upper corner 208 of the fixture 186 removes the risk of the fixture 186 not disengaging the prongs 158. For example, if the engagement portion of the fixture 186 was square or rectangular shape the disengagement may not be as smooth if the fixture where to get stuck when moving up to disengage the prongs 158. After disengaging the prongs 158 from the corresponding recesses 162, the guide rod 121 can move up which can move the upper hub 120 upwards. As described herein, the upper hub 120 moving upwards when the umbrella 100 closes can prevent or limit the ribs 138 from contacting other objects external to the umbrella 100, such as tables or chairs.

Figure 6B:
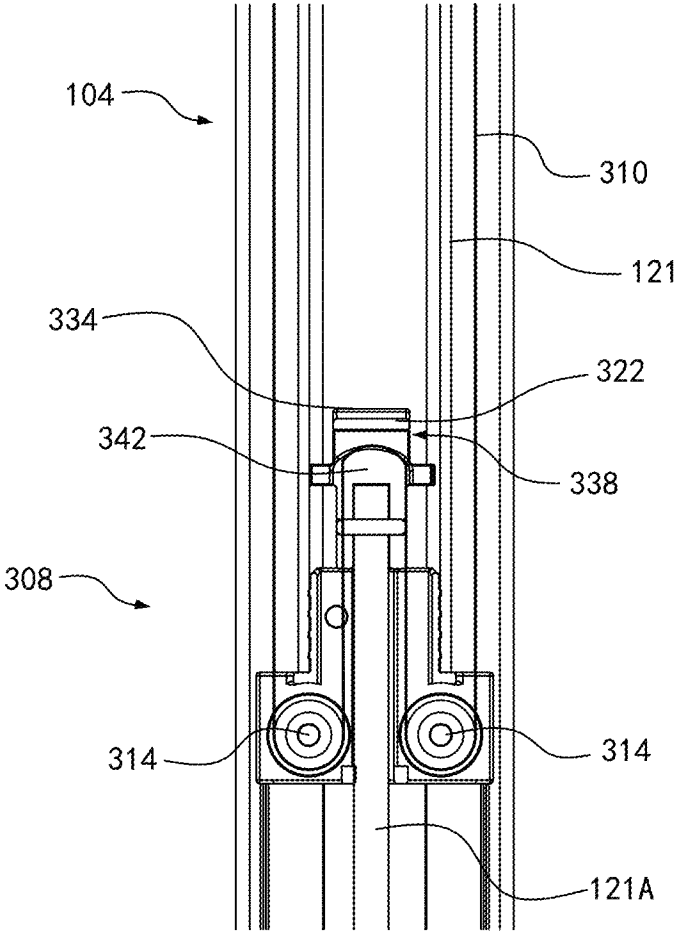
FIG. 6B shows a cross section of the umbrella of FIG. 4 illustrating a guide rod lifting mechanism including a pulley, a cord, and an extender.
Figure 6C:
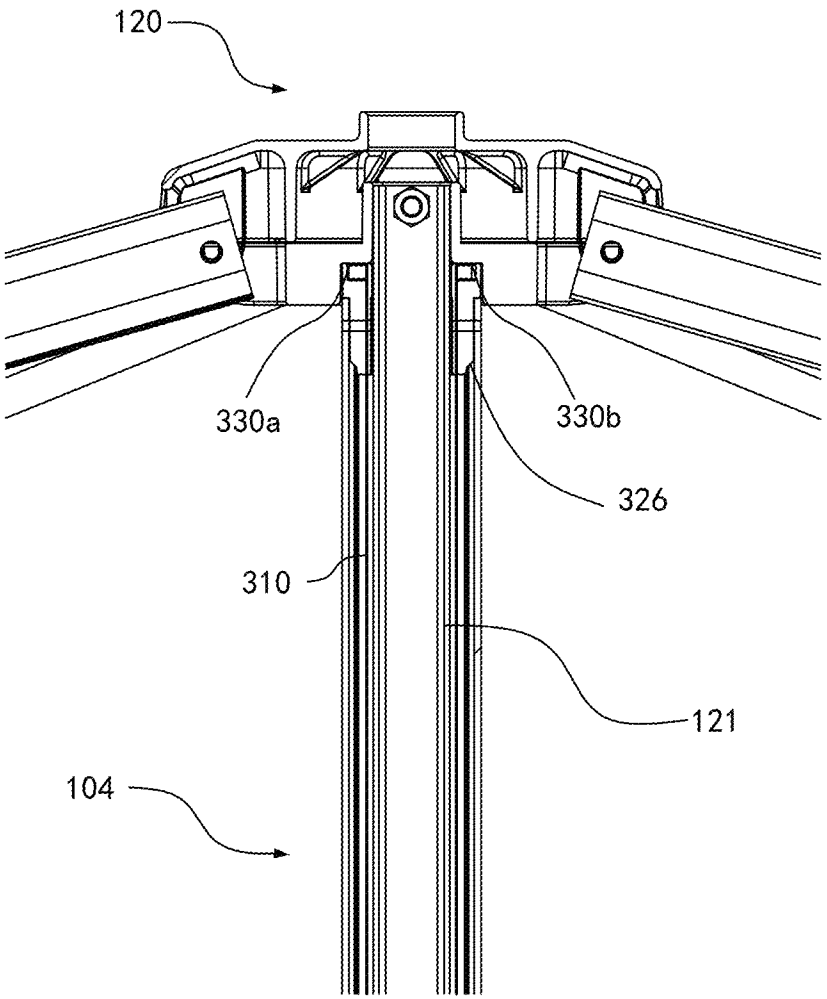
FIG. 6C shows a cross section of the umbrella of FIG. 4 illustrating an upper hub and the cord illustrated in FIG. 6B.

FIGS. 6B and 6C illustrate section views of the umbrella 100 having a guide rod lifting assembly 308. The guide rod lifting assembly 308 can move the upper hub 120 upward when the umbrella 100 is closed. The guide rod lifting assembly 308 can include a cord 310, at least one pulley 314, and an extender 121A. As described above, the extender 121A can be disposed within the pole assembly 104 and can be positioned next to the pushrod 190. At least one pulley 314 is coupled to the upper spacer 183 cap disposed at a bottom portion of the guide rod 121. The extender 121A can be slideably disposed through an aperture in the upper spacer 183 such that a top portion thereof can be extended past the elevation of the pulley(s) 314 as discussed below. The extender 121A can have a fixture 334 coupled to the upper portion of the extender 121A, as shown in FIGS. 5 and 6B. The fixture 334 can have an opening 338 that the cord 310 can extend through. The lower portion 342 of the opening 338 may have a rounded edge, as shown in FIG. 6B.

The pole assembly 104 can have ring 326 coupled to the upper portion of the pole assembly, as shown in FIG. 6C. The ring 326 can have points 330*a*, 330*b* where the cord 310 can be coupled at each end to the pole assembly 104 by any suitable means. A first end of the cord 310 can be coupled or anchored to point 330*a*. The cord can then extend down the pole assembly 104 at least partially between an inner surface of the pole assembly 104 and an outer surface of the guide rod 121. The cord 310 can then extend under a pulley 314 upward and through the opening 338 of the fixture 334. The lower portion 342 of the opening 338 can have a rounded edge or profile that can allow the cord 310 to extend through the opening 338 without any sharp turns or sharp edges. The cord 310 can then extend downward from the fixture 334 and under a second pulley 314. The cord 310 can then extend upward between an inner surface of the pole assembly 104 and an outer surface of the guide rod 121. The second end of the cord 310 can be coupled or anchored to point 330*b*. In one configuration, the points 330*a*, 330*b* are openings in an upper surface of the ring 326. The cord 310 can be knotted at an end portion above the openings in the ring 326 such that the cord 310 will not pull through the openings.

As described throughout, the upper hub 120 of the umbrella 100 can move in the upward direction when the umbrella 100 is closed. The lower hub 124 can be moved downward to close the umbrella 100. As described in more detail above, when the lower hub 124 is moved downward, the ballast 170 moves upward pushing the pushrod 190 upward which advances the fixture 186 upward toward the prongs 158 to unlock the umbrella 100. When the pushrod 190 has moved a distance L, as described above, the ballast 170 moving upward can continue to move the extender 121A in the upward direction. The extender 121A can comprise a second pushrod disposed alongside the pushrod 190. The extender 121A moving upward can apply a force to the guide rod 121 and assist the guide rod 121 to move upward, which can assist the upper hub 120 in moving upward. In particular, the upward movement of the extender 121A raises the span of the cord 310 over the lower portion 342 of the opening 338. The ends of the cord 310 at points 330*a*, 330*b* are fixed. Raising the span of the cord 310 over the lower portion 342 raises the pulleys 314 relative to the points 330*a*, 330*b*, which raises the guide rod 121. While the extender 121A is moving upward (e.g., when closing the umbrella), the length of the cord 310 between points 330*a*, 330*b* and the pulleys 314 will decrease, while the length of the cord 310 between the opening 338 and the pulleys 314 will increase. When the extender 121A moves downward (e.g., when opening the umbrella), the length of the cord 310 between points 330*a*, 330*b* will increase, while the length of the cord 310 between the opening 338 and the pulleys 314 will decrease. Also, while the extender 121A is moving upward, the length of the extender 121A within the guide rod 121 will increase. When the extender 121A moves downward (e.g., when opening the umbrella), the length of the extender 121A within the guide rod 121 will decrease.

Figure 7:
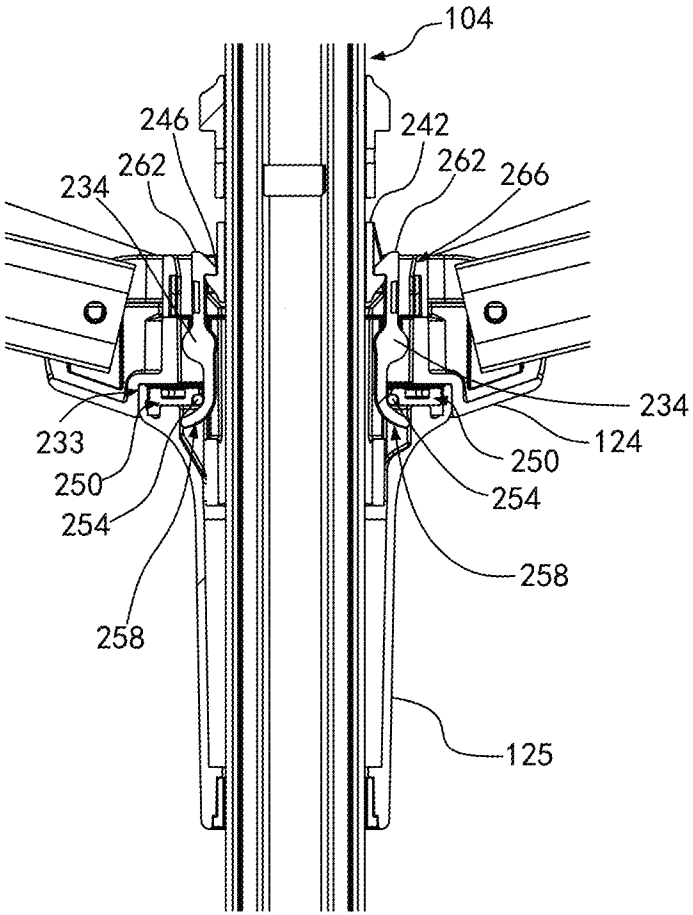
FIG. 7 shows a cross section of the umbrella of FIG. 4 illustrating a lower hub and a handle when an umbrella is in an open state.

FIG. 7 illustrates a section view of the lower hub 124 and the handle 125 of an umbrella 100 when the umbrella 100 is in an open state. The handle 125 is positioned in a recess 233 of the lower hub 124. When the handle 125 is pulled down, the handle 125 can create a separation between the upper portion 250 of the handle 125 and an internal aspect of the recess 233 of the lower hub 124. The lower hub 124 is secured to the pole assembly 104 via hooks 234. The illustrated embodiment shows two hooks 234, but any number of hooks 234 can be used. For example, 1, 2, 3, 4, or more hooks 234 can be used. The hooks 234 can include a lower rounded portion 258 and a prong 262 configured to engage a ring 242. The ring 242 can be coupled to the exterior of the pole assembly 104. The ring 242 can include a ledge 246.

The hooks 234 engage with ring 242 to secure the lower hub 124 in a locked state, securing the umbrella 100 in an open state. In one embodiment, the hooks 234 can be used with the locking device 116, described above, to better secure the umbrella 100 in an open state. The ring 242 partially or completely encircles the pole assembly 104. The ledge 246 can engage the hooks 234. The ledge 246 can extend around the entire ring 242 or one or more ledges 246 can be provided at the location of the hooks 234. The lower rounded portion 258 of the hooks 234 are configured to interact with pins 254 to secure and unsecure the lower hub 124 to the pole assembly 104.

Figure 8:
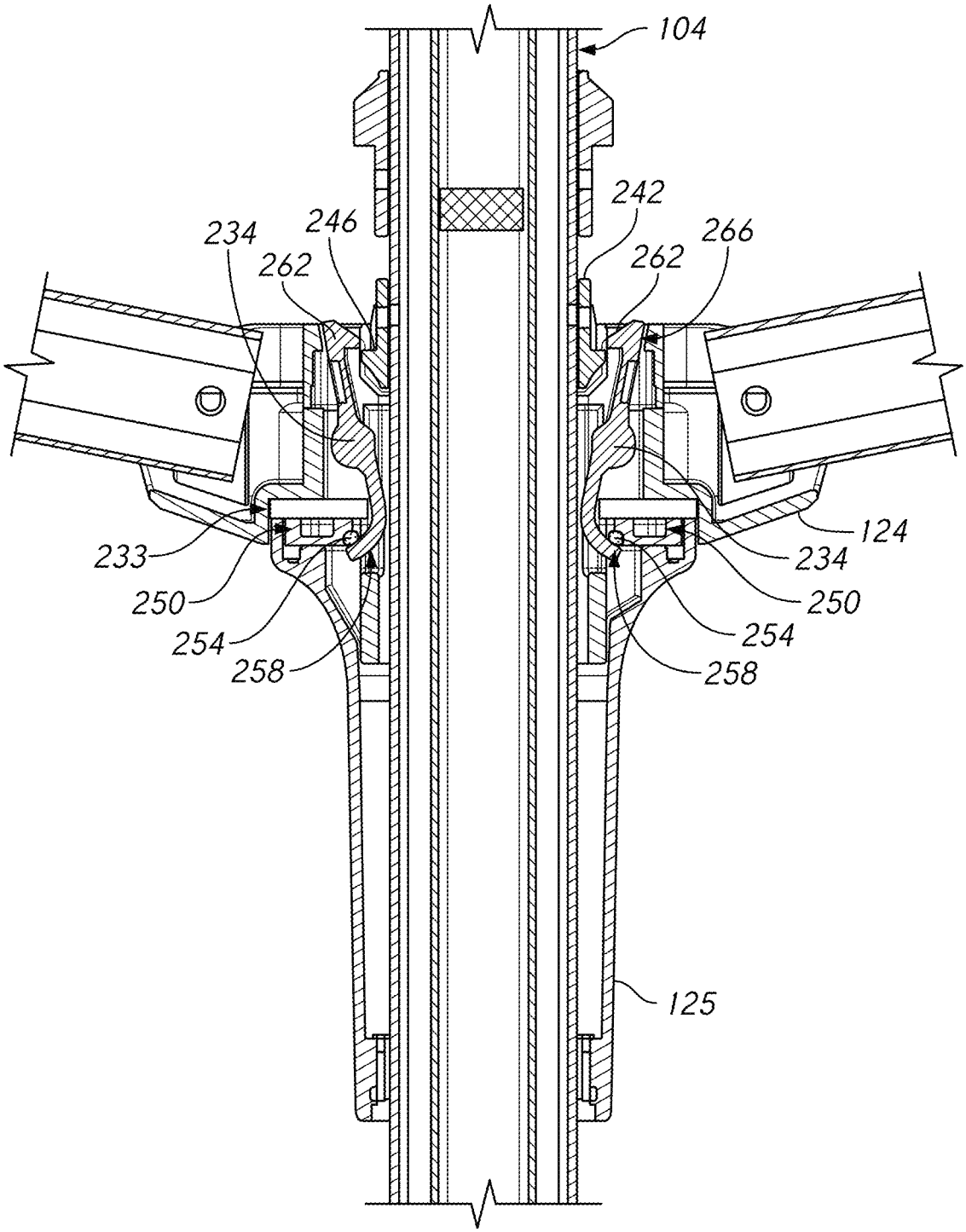
FIG. 8 shows a cross section of the umbrella of FIG. 4 similar to that of FIG. 7 illustrating a lower hub and a handle when a handle has been pulled down to disengage the lower hub from a ledge securing the lower hub to the pole assembly.

FIG. 8 illustrates a section view of a lower hub 124 and a handle 125 of an umbrella 100 when the umbrella 100 is being moved to a closed state. To close the umbrella 100, the handle 125 can be pulled down relative to the portion of the lower hub 124 coupled with the struts 134. The upper portion 250 of the handle 125 moves downward from the recess 233 of the lower hub 124 as shown in FIGS. 7 and 8. The downward movement of the upper portion 250 of the handle 125 can allow pins 254 to move down and apply a force to the lower rounded portion 258 of the hooks 234. The application of this force can cause the hooks 234 to disengage from the ledge 246 of the ring 242. FIG. 8 illustrates the hooks 234 moving away from the ledge 246 of the ring 242. The distance the hooks 234 move from the ledge 246 of the ring 242 can be limited by an interior wall 266 of the lower hub 124. The interior wall 266 encircles the hooks 234 around the pole assembly 104. The interior wall 266 limiting the distance the hooks 234 can allow for a more controlled locking and unlocking process. The disengagement of the hooks 234 can allow the lower hub 124 to move down the pole assembly 104 allowing the umbrella 100 to close.

Figure 9:
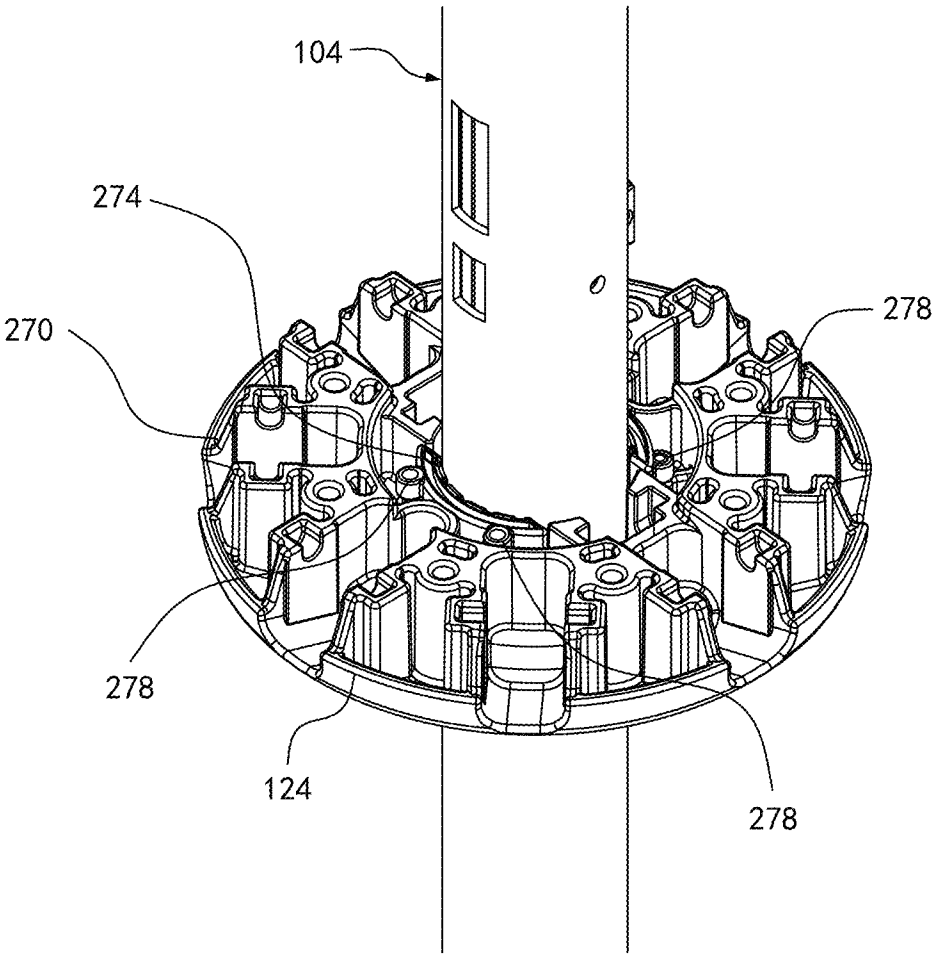
FIG. 9 shows a top perspective view of a portion of a lower hub assembly, an upper portion thereof having been removed to show a spacer.

FIG. 9 shows a top perspective view of a bottom portion 270 of the lower hub 124. An upper portion (not shown) has been removed to illustrate internal components. A spacer 274 is positioned in the center of the bottom portion 270 between the pole assembly 104 and the lower hub 124. The spacer 274 can be made of plastic. In the illustrated embodiment, the spacer 274 includes aligners 278. There can be one, two, three, four or more aligners 278. The aligners 278 can be used to secure the spacer 274 in place or in a predetermined location. In the illustrated embodiment, the aligners 278 are ring-like tabs securing the spacer 274 to the lower hub. The ring-like tabs of the aligners 278 can be advanced over pins molded, formed or mounted in the bottom portion 270 of the lower hub 124. In other embodiments, the aligners 278 or other suitable means can be provided to couple or attach the spacer 274 to the lower hub 124.

In the illustrated embodiment, two spacers 274 can be provided. In other embodiments, the spacer 274 can be one piece the encircles the entire diameter of the pole assembly 104. In some embodiments, the pole assembly 104 and the lower hub 124 can be metallic. The lower hub 124 moves along the pole assembly 104 as previously described and the spacer 274 can prevent or limit the wearing down of the pole assembly 104 and the lower hub 124.

Figure 10:
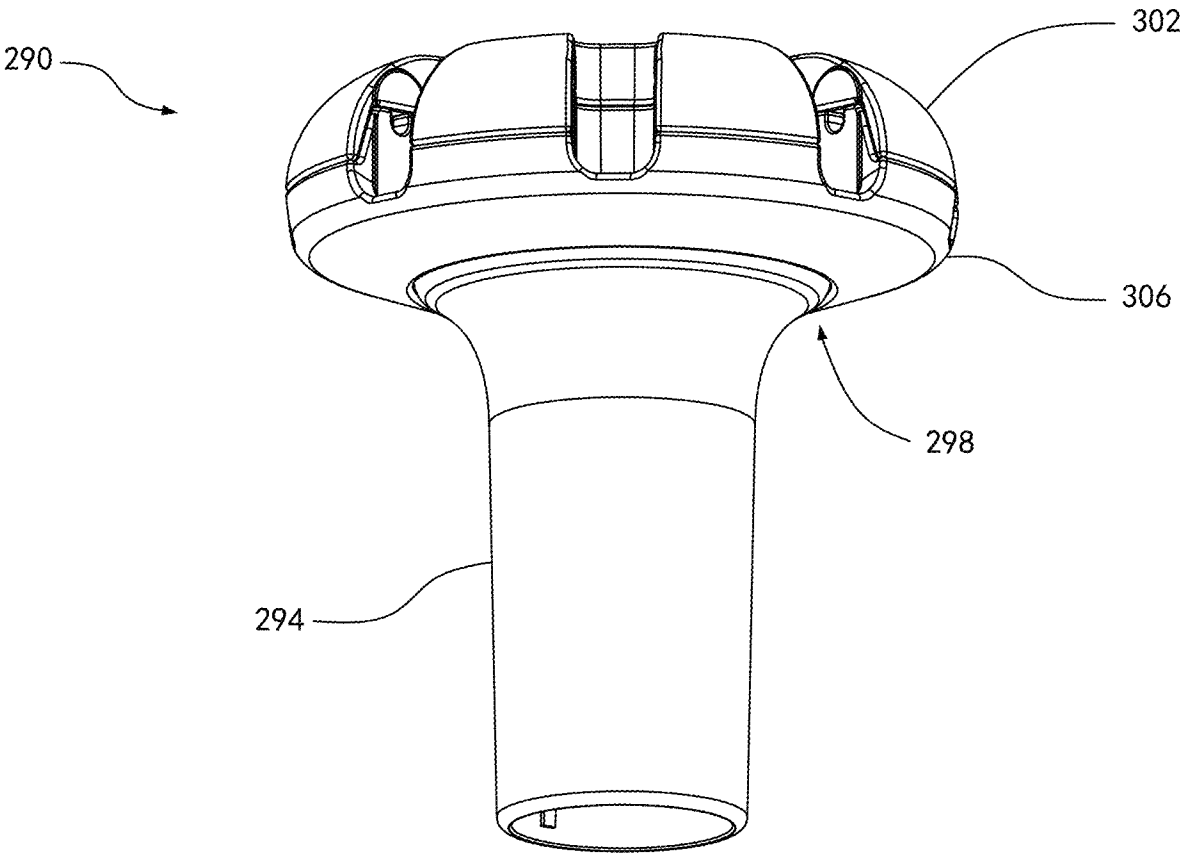
FIG. 10 shows a perspective view of a design of an umbrella hub with a handle.
Figure 11:
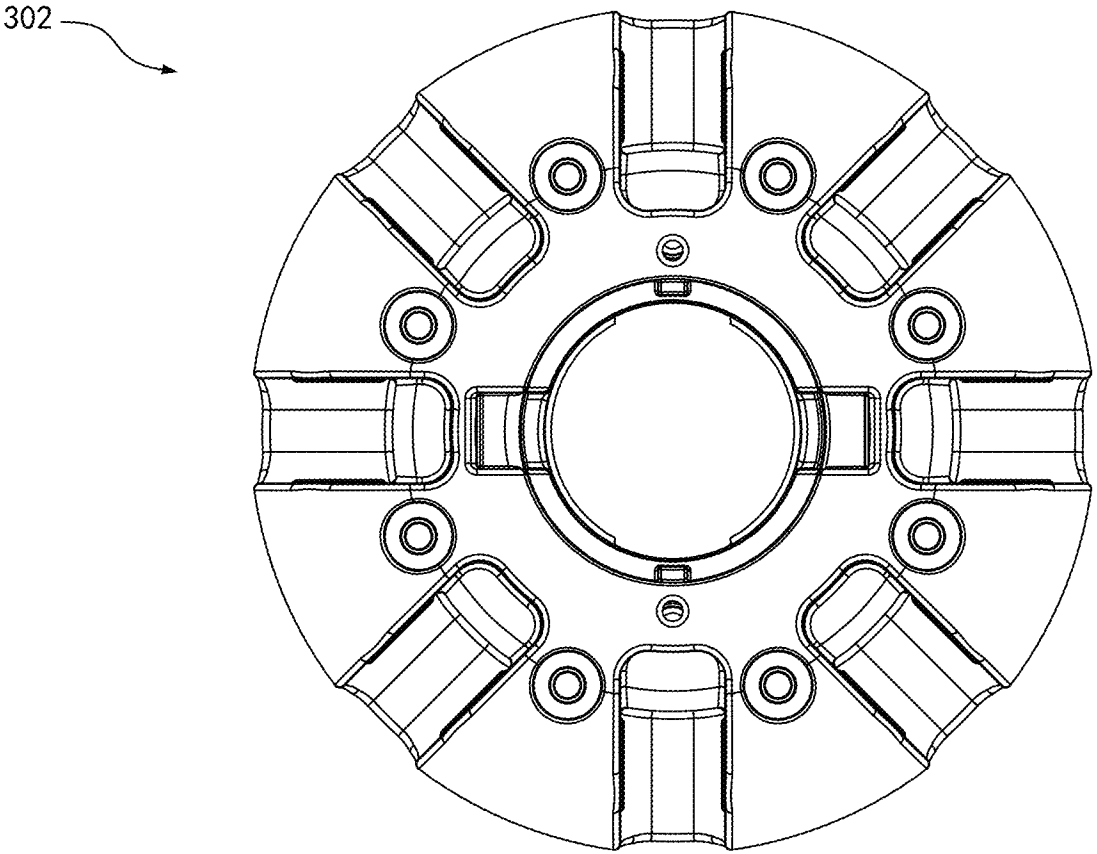
FIG. 11 shows a top view of the umbrella hub design of FIG. 10.
Figure 12:
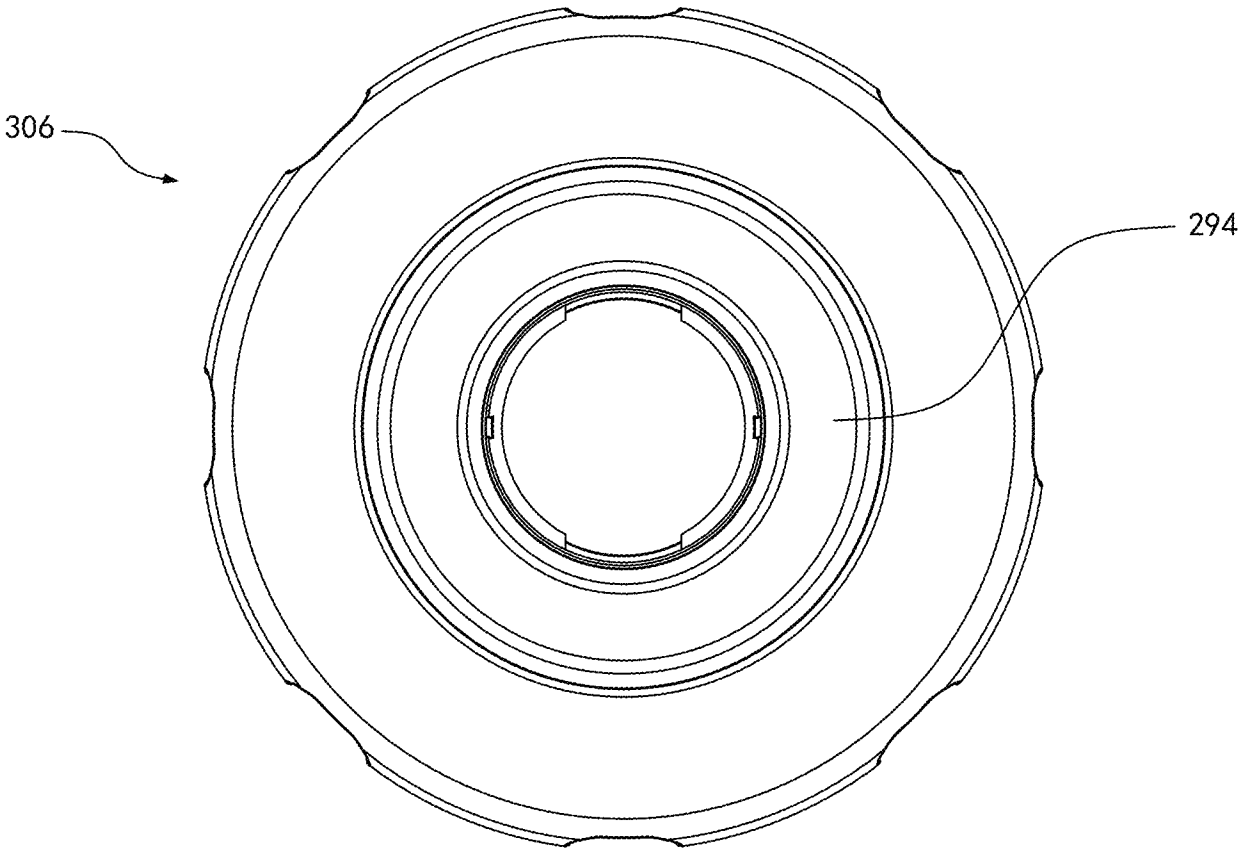
FIG. 12 shows a bottom view of the umbrella hub design of FIG. 10.

FIGS. 10-14 show a design of an umbrella hub 290. FIG. 10 shows a perspective view of a design of an umbrella hub 290 with a handle 294 in a first position. An upper portion of the umbrella hub 290 can be positioned above the handle 294. An upper portion of the handle 294 is positioned in a recess 298 of the umbrella hub 290. The upper portion of the umbrella hub 290 can include two portions, a top portion 302 and a bottom portion 306. FIG. 11 shows a top view of the top portion 302 of the umbrella hub 290 design of FIG. 10. FIG. 12 shows a bottom view of the bottom portion 306 and of the handle 294 of the umbrella hub 290 design of FIG. 10.

Figure 13:
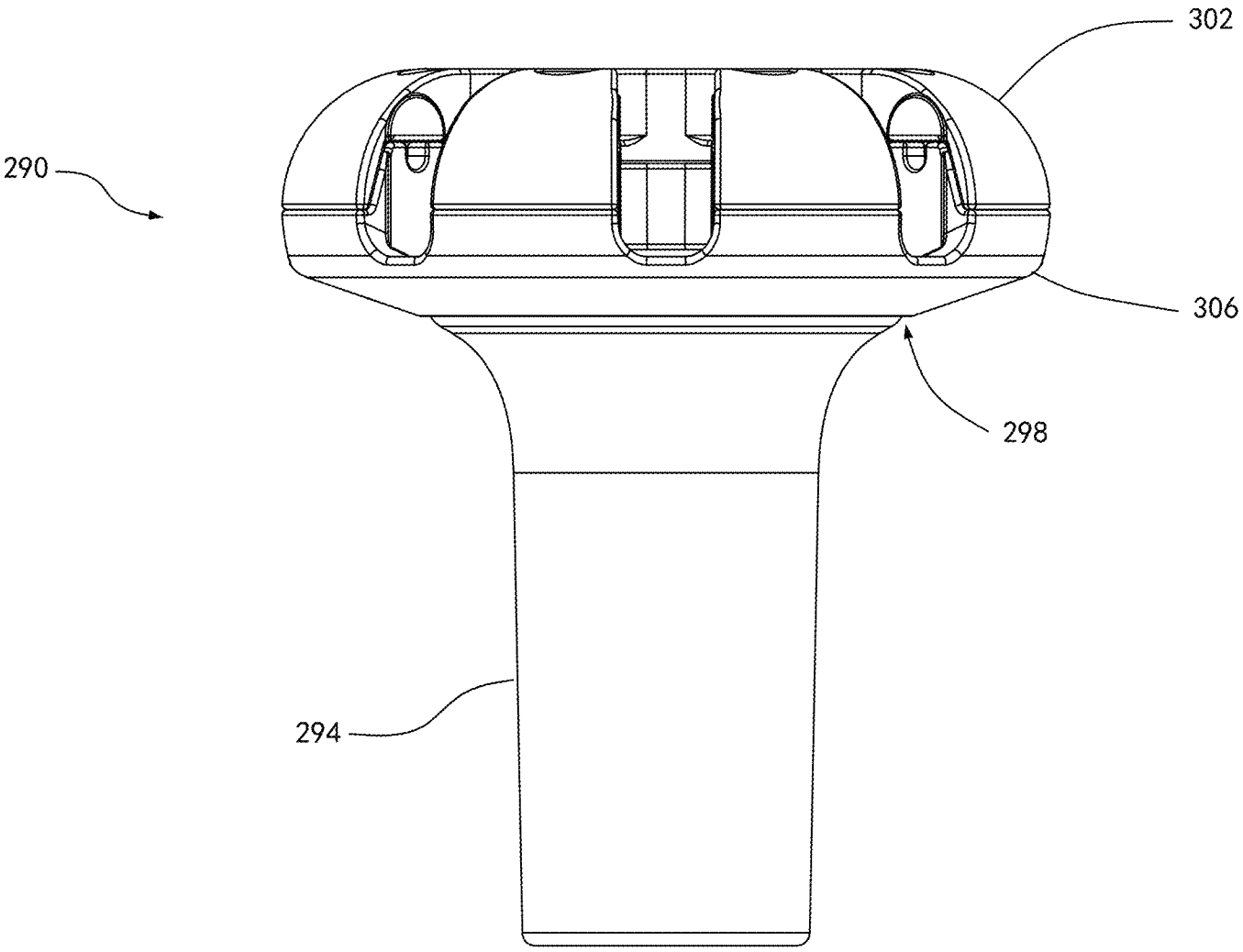
FIG. 13 shows a side view of the umbrella hub design of FIG. 10 with the handle in a first position.
Figure 14:
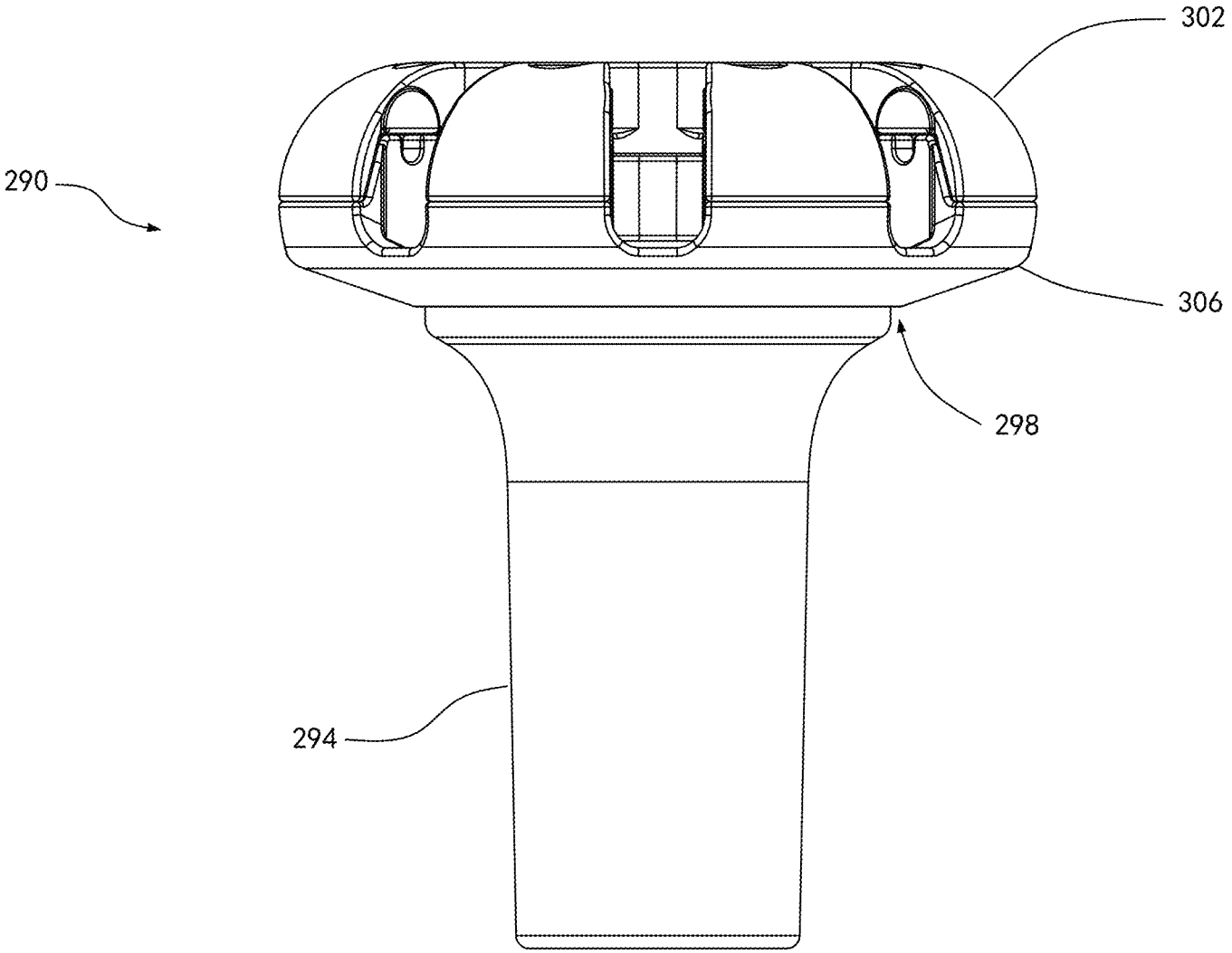
FIG. 14 shows a side view of the umbrella hub design of FIG. 10 with the handle in a second position.

FIG. 13 shows a side view of the umbrella hub 290 design of FIG. 10 with a handle 294 in a first position. The handle 294 is positioned in the recess 298 of the umbrella hub 290. FIG. 14 shows a side view of the umbrella hub 290 design of FIG. 10 with a handle 294 in a second position. In FIG. 14, an upper portion of the handle 294 has been moved downward and partially out of the recess 298.

While certain embodiments of the inventions have been described, these embodiments have been presented by way of example only, and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. The accompanying claims and their equivalents are intended to cover such forms or modifications as would fall within the scope and spirit of the disclosure. Accordingly, the scope of the present inventions is defined only by reference to the appended claims.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, or 0.1 degree.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

What is claimed is:

1. An umbrella comprising:

a pole assembly comprising an upper portion, a lower portion, the pole assembly enclosing an interior space disposed along a longitudinal axis thereof;

a shade assembly disposed above the lower portion of the pole assembly, the shade assembly coupled with the upper portion of the pole assembly, the shade assembly comprising:

two or more ribs, a corresponding number of struts, a shade member, an upper hub and a lower hub, wherein the lower hub is moveable along the pole assembly, wherein the struts are coupled at one end to the corresponding ribs and at their other end coupled to the lower hub;

the upper hub comprising a guide rod moveable within the pole assembly, at least two recesses extending into the guide rod;

a counterweight system disposed within the interior space of the pole assembly, the counterweight system comprising a ballast, a cord having a first end coupled with the ballast and a second end coupled the lower hub, the cord being disposed over a pulley between the first end and the second end;

a locking device, the locking device comprising a hook assembly and a pushrod mechanism, the hook assembly comprising at least two prongs sized to fit within the at least two recesses and a spring configured to urge the at least two prongs into engagement with the at least two recesses to lock the umbrella in an open state, the pushrod mechanism disposed through a lower end of the guide rod, the pushrod mechanism comprising a fixture, a pushrod coupled to the fixture, and a lower surface disposed opposite to the fixture, and;

a handle extending downward from a lower portion of the lower hub;

wherein when opening the umbrella, the handle can be raised to raise the lower hub in an upward direction along the pole assembly as the ballast moves down within the interior space of the pole assembly, while at the same time the upper hub is lowered until the at least two recesses are aligned with the at least two prongs;

wherein when closing the umbrella, the lower surface is actuated to move the fixture upward to disengage the at least two prongs from the at least two recesses of the guide rod, allowing the handle to move downward and the ballast to move upward.

2. The umbrella of claim 1, wherein the fixture has an upper corner configured to disengage the at least two prongs wherein the upper corner is angled.

3. The umbrella of claim 1, wherein the fixture has at least one width that corresponds to a width of an inner passage of the guide rod.

4. The umbrella of claim 1, wherein the pulley is mounted to the upper portion of the pole assembly.

5. An umbrella comprising:

a pole assembly enclosing an interior space disposed along a longitudinal axis thereof;

a shade assembly coupled with an upper portion of the pole assembly, the shade assembly comprising:

a plurality of ribs, a plurality of struts, a shade member, an upper hub and a lower hub, wherein the plurality of struts are coupled at one end to a corresponding one of the plurality of ribs and at an opposite end to the lower hub;

the upper hub comprising a guide rod within the pole assembly, at least one recess extending into the guide rod;

a counterweight system disposed within the interior space of the pole assembly, the counterweight system comprising a ballast, a cord having a first end coupled with the ballast and a second end coupled the lower hub;

a locking device, the locking device comprising a hook assembly and a pushrod mechanism, the hook assembly comprising at least one prong sized to fit within the at least one recess and a spring configured to urge the at least one prong into engagement with the at least one recess to lock the umbrella in an open state, the pushrod mechanism comprising a pushrod coupled to a fixture, the pushrod coupled with a lower end of the guide rod, a lower end of the pushrod disposed below the hook assembly and below the lower end of the guide rod;

wherein when closing the umbrella, the pushrod is actuated to move the fixture upward to disengage the at least one prong from the at least one recess of the guide rod, to allow the lower hub to be moved downward and the ballast to move upward.

6. The umbrella of claim 5, wherein there are a plurality of recesses extending into the guide rod.

7. The umbrella of claim 5, further comprising a handle extending downward from a lower portion of the lower hub.

8. The umbrella of claim 5, wherein the cord is disposed over a pulley.

9. The umbrella of claim 5, wherein when opening the umbrella, the lower hub can be raised in an upward direction along the pole assembly as the ballast moves down within the pole assembly, while at the same time the upper hub is lowered until the at least one recess is aligned with the at least one prong.

10. The umbrella of claim 5, wherein the fixture has an upper corner configured to disengage the at least one prong wherein the upper corner is angled.

11. The umbrella of claim 5, wherein the fixture has at least one width that is less than a width of an inner passage of the guide rod.

12. An umbrella comprising:

a hollow pole;

a shade assembly coupled with an upper portion of the hollow pole, the shade assembly comprising:

an upper hub, a lower hub, a shade structure coupling the upper hub to the lower hub, the shade structure supporting a shade member, wherein the lower hub is moveable along the hollow pole;

a guide rod coupled with the upper hub at a first end, a second end being disposed within the hollow pole, the guide rod having a stop surface;

a counterweight system disposed within the hollow pole, the counterweight system comprising a ballast and a cord having a first end coupled with the ballast and a second end coupled with the lower hub;

a locking device comprising a moveable locking surface disposed on the hollow pole and a pushrod mechanism, the moveable locking surface being sized to overlap with the stop surface to lock the umbrella in an open state, the pushrod mechanism comprising a pushrod extending below the lower hub;

wherein when closing the umbrella, the pushrod mechanism moves upward disengaging the moveable locking surface from the stop surface of the guide rod, allowing the lower hub to be moved downward and the ballast to move upward.

13. The umbrella of claim 12, wherein the locking device further comprises a fixture coupled to the pushrod at an upper end thereof, the fixture configured to urge the moveable locking surface away from the stop surface.

14. The umbrella of claim 13, wherein the fixture has an upper corner configured to disengage at least two prongs of the locking device, wherein the upper corner is angled.

15. The umbrella of claim 14, wherein the upper corner comprises a wedge surface configured to act on a wedge surface of a hook of the locking device.

16. The umbrella of claim 12, wherein the moveable locking surface comprises a hook.

17. The umbrella of claim 16, wherein the stop surface comprises a recess configured to engage the hook.

18. The umbrella of claim 12, further comprising a fixture coupled to the pushrod mechanism wherein when closing the umbrella, the fixture disengages the moveable locking surface from the stop surface.

19. The umbrella of claim 12 further comprising a hook pivotably mounted in the lower hub, the hook configured to rest on a ledge of the hollow pole when the umbrella is open and to pivot away from the ledge to allow the umbrella to be closed, the pivoting of the hook being actuated by downward movement of a handle portion of the lower hub.

20. The umbrella of claim 19, further comprising a handle extending downward from a lower portion of the lower hub, the handle being moveable downward when the hook is resting on the ledge to pivot the hook away from the ledge to allow the lower hub to be lowered to allow the umbrella to collapse.

21. The umbrella of claim 20, wherein the hook comprises a curved lower portion that is actuated by movement of a roller disposed in the handle.

22. The umbrella of claim 12, wherein the cord is disposed over a pulley coupled with the hollow pole and is tension by downward movement of the lower hub.

23. The umbrella of claim 12, further comprises a spring configured to engage the moveable locking surface with the stop surface.

24. The umbrella of claim 12, wherein downward movement of the lower hub raises the ballast into engagement with an extender coupled with the guide rod and further downward movement of the lower hub causes the guide rod to apply an upward force to the extender and thereby to the guide rod to raise the upper hub.

25. The umbrella of claim 12, further comprising an upper spacer coupled with a lower portion of the guide rod and a lower spacer disposed below the upper spacer, the upper and lower spacers disposed in the hollow pole, the pushrod mechanism being moveable through the upper and lower spacers between a position below the moveable locking surface to a position at or above the moveable locking surface.

26. The umbrella of claim 25, wherein the pushrod mechanism includes a fixture coupled with an upper portion of a pushrod, the pushrod having a slot disposed therethrough at least partially delimiting a range of motion of the fixture.

27. The umbrella of claim 12, further comprising a guide rod lifting mechanism comprising a second cord coupled at a first end and at a second end opposite the first end with an upper portion of the hollow pole, the second cord having a span extending from the first end to a second end and over a first pulley, the span of the second cord being coupled with an upper end of an extender within the guide rod, wherein downward movement of the lower hub causes upward movement of the extender, whereby a length of a portion of the span of the second cord between the first pulley and the first end of the cord is shortened and the guide rod and the upper hub are raised.

28. The umbrella of claim 27, wherein the guide rod lifting mechanism comprises a second pulley, the span of the second cord extending between the first end and the first pulley, over the upper end of the extender, and from the second pulley to the second end, wherein the length of a portion of the span of the second cord between the second pulley and the second end of the cord is shortened when the lower hub is moved downward.

* * * * *